US010633949B2

(12) United States Patent
Tilley et al.

(10) Patent No.: US 10,633,949 B2
(45) Date of Patent: Apr. 28, 2020

(54) TOP-DOWN SQUEEZE SYSTEM AND METHOD

(71) Applicant: Halliburton Energy Services, Inc., Houston, TX (US)

(72) Inventors: David Jon Tilley, Franklin, LA (US); Phillip Michael Morgan, Lafayette, LA (US); James Todd Johnson, Broussard, LA (US); Michael Rick Johnson, Lafayette, LA (US); Nicholas Lee Strohla, Dallas, TX (US); Matthew Ryan Gray, Dallas, TX (US); Daniel Keith Moeller, Argyle, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/301,698

(22) PCT Filed: Jul. 7, 2016

(86) PCT No.: PCT/US2016/041257

§ 371 (c)(1),
(2) Date: Nov. 14, 2018

(87) PCT Pub. No.: WO2018/009191

PCT Pub. Date: Jan. 11, 2018

(65) Prior Publication Data

US 2019/0284899 A1 Sep. 19, 2019

(51) Int. Cl.
*E21B 33/14* (2006.01)
*E21B 34/14* (2006.01)

(52) U.S. Cl.
CPC ..... *E21B 33/14* (2013.01); *E21B 33/143* (2013.01); *E21B 34/14* (2013.01)

(58) Field of Classification Search
CPC ..... E21B 33/138; E21B 33/13; E21B 43/26; E21B 33/16; E21B 34/14; E21B 43/114; E21B 33/05
See application file for complete search history.

(56) References Cited

U.S. PATENT DOCUMENTS 4,260,017 A 4/1981 Nelson et al.
4,479,545 A 10/1984 Eley
(Continued)

FOREIGN PATENT DOCUMENTS

WO 2011106579 A2 9/2011

OTHER PUBLICATIONS

International Search Report and Written Opinion dated Apr. 6, 2017; International PCT Application No. PCT/US2016/041257.
(Continued)

*Primary Examiner* — Zakiya W Bates
(74) *Attorney, Agent, or Firm* — McGuireWoods LLP

(57) ABSTRACT

A diverter assembly includes a tubing segment and one or more sleeve members disposed therein. The tubing segment includes apertures that are selectively alignable with apertures of an inner sleeve disposed within the tubing segment. The tubing segment includes a series of stops (e.g., shear pins) to arrest movement of the first sleeve within the bore of the tubing segment. A first one or more ball seats are included in the first sleeve such that deployment of a first ball and pressurization of the well above the first ball causes a first set of shear pins to fail, thereby allowing the first sleeve to slide downhole to cause apertures of the sleeve to align with apertures of the tubing segment, thereby causing fluid to flow to an annulus between the tubing segment and wellbore wall.

17 Claims, 21 Drawing Sheets

(56) References Cited

U.S. PATENT DOCUMENTS

| | | | | |
|---|---|---|---|---|
| 5,117,910 | A * | 6/1992 | Brandell | E21B 33/126 166/154 |
| 5,411,095 | A | 5/1995 | Ehlinger et al. | |
| 8,496,051 | B2 | 7/2013 | Cejero et al. | |
| 8,555,983 | B2 | 10/2013 | Palacios | |
| 2009/0056952 | A1 | 3/2009 | Churchill | |
| 2015/0184489 | A1 | 7/2015 | Resweber | |

OTHER PUBLICATIONS

European Search Report dated Dec. 20, 2019; EP Application No: 16908311.0.

* cited by examiner

TOP-DOWN SQUEEZE SYSTEM AND METHOD

BACKGROUND

The present disclosure relates to oil and gas exploration and production, and more particularly to a completion tool used in connection with delivering cement to a wellbore.

Wells are drilled at various depths to access and produce oil, gas, minerals, and other naturally-occurring deposits from subterranean geological formations.

Hydraulic cement compositions are commonly utilized to complete oil and gas wells that are drilled to recover such deposits. For example, hydraulic cement compositions may be used to cement a casing string in a wellbore in a primary cementing operation. In such an operation, a hydraulic cement composition is pumped into the annular space between the walls of a well bore and the exterior of a casing string disposed therein. After pumping, the composition sets in the annular space to form a sheath of hardened cement about the casing. The cement sheath physically supports and positions the casing string in the well bore to prevent the undesirable migration of fluids and gasses between zones or formations penetrated by the well bore.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

Figure 1:
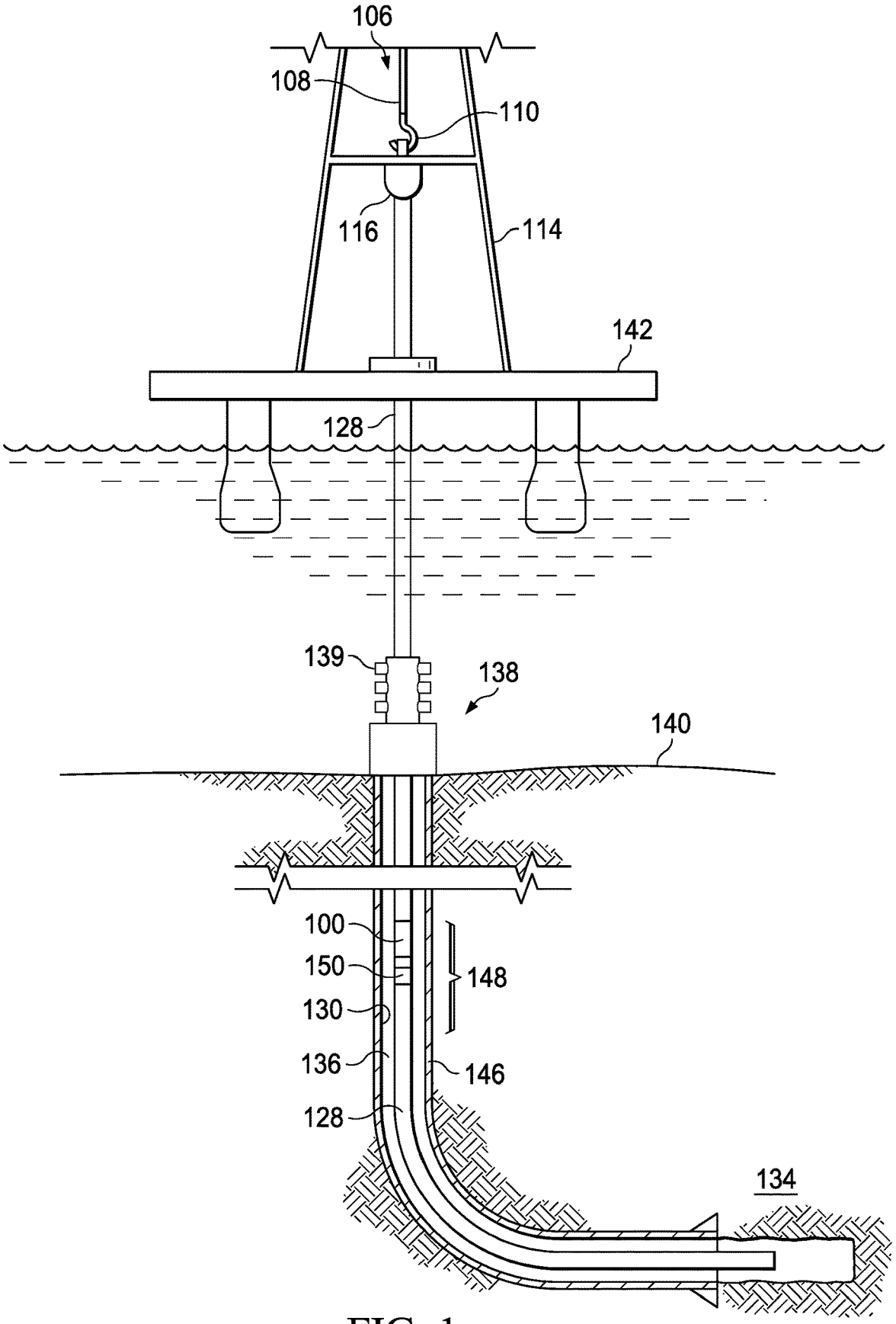
FIG. 1 illustrates a schematic view of an off-shore well in which a tool string is deployed according to an illustrative embodiment.

The illustrated figures are only exemplary and are not intended to assert or imply any limitation with regard to the environment, architecture, design, or process in which different embodiments may be implemented.

DETAILED DESCRIPTION OF ILLUSTRATIVE EMBODIMENTS

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, fluidic, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments is defined only by the appended claims.

After primary cementing, it may be necessary in some instances to cement a portion of a wellbore that extends above a previously cemented portion of the wellbore. In in such instances, a "squeeze" operation may be employed in which the cement is deployed in an interval of a wellbore from the top down (i.e., downhole). The present disclosure relates to subassemblies, systems and method for diverting fluid in a wellbore to, for example, divert a cement slurry from a work string, such as a drill string, landing string, completion string, or similar tubing string to an annulus between the external surface of the string and a wellbore wall to form a cement boundary over the interval and isolate the wellbore from the surrounding geographic zone or other wellbore wall.

The disclosed subassemblies, systems and methods allow an operator to perform a top-down squeeze cementing operation immediately following a traditional cementing operation and then return to a standard circulation path upon completion of the squeeze job. To that end, a diverter assembly is disclosed that has the ability to allow the passage of displacement based equipment (e.g., a cement displacement wiper dart) and fluid through its center and continue downhole while retaining the ability to open ball-actuated ports or apertures that provide a pathway to the annulus outside of the subassembly. Opening of the apertures for fluid to be diverted from the tool string to flow cement slurry or a similar fluid downhole along the annulus to perform a top-down cementing or "squeeze" operation. Following circulation of the cement, the apertures may be closed so that the tool string may be pressurized to set a tool, such as a liner hanger. The closing may also be ball-actuated, in addition to the liner hanger or other tool. To that end, the second ball may be used to close the valve and may also be used to actuate and set the liner hanger or similar tool downhole from the diverter assembly.

Cementing may be done in this manner for any number of reasons. For example, regulatory requirements may necessitate cementing a zone of a wellbore that is uphole from a zone where hydrocarbons are discovered proximate and above a previously cemented zone, or a cement interval may receive cement from a bottom hole assembly and benefit from additional cement being applied from the top of the interval.

Turning now to the figures, FIG. 1 illustrates a schematic view of an offshore platform 142 operating a tool string 128 that includes a diverter assembly 100 according to an illustrative embodiment, which may be used in top-down squeeze operations or to set a liner hanger. The diverter assembly 100 in FIG. 1 may be deployed to enable the application of a top-down squeeze operation in a zone 148 downhole from the diverter assembly 100 and to set a liner hanger 150 downhole from the diverter assembly 100. The tool string 128 may be a drill string, completion string, landing string or other suitable type of work string used to complete or maintain the well. In the embodiment of FIG. 1, the tool string 128 is deployed through a blowout preventer 139 in a sub-sea well 138 accessed by the offshore platform 142. As referenced herein, the "offshore platform" 142 may be a floating platform, a platform anchored to a seabed 140 or a vessel.

Figure 2:
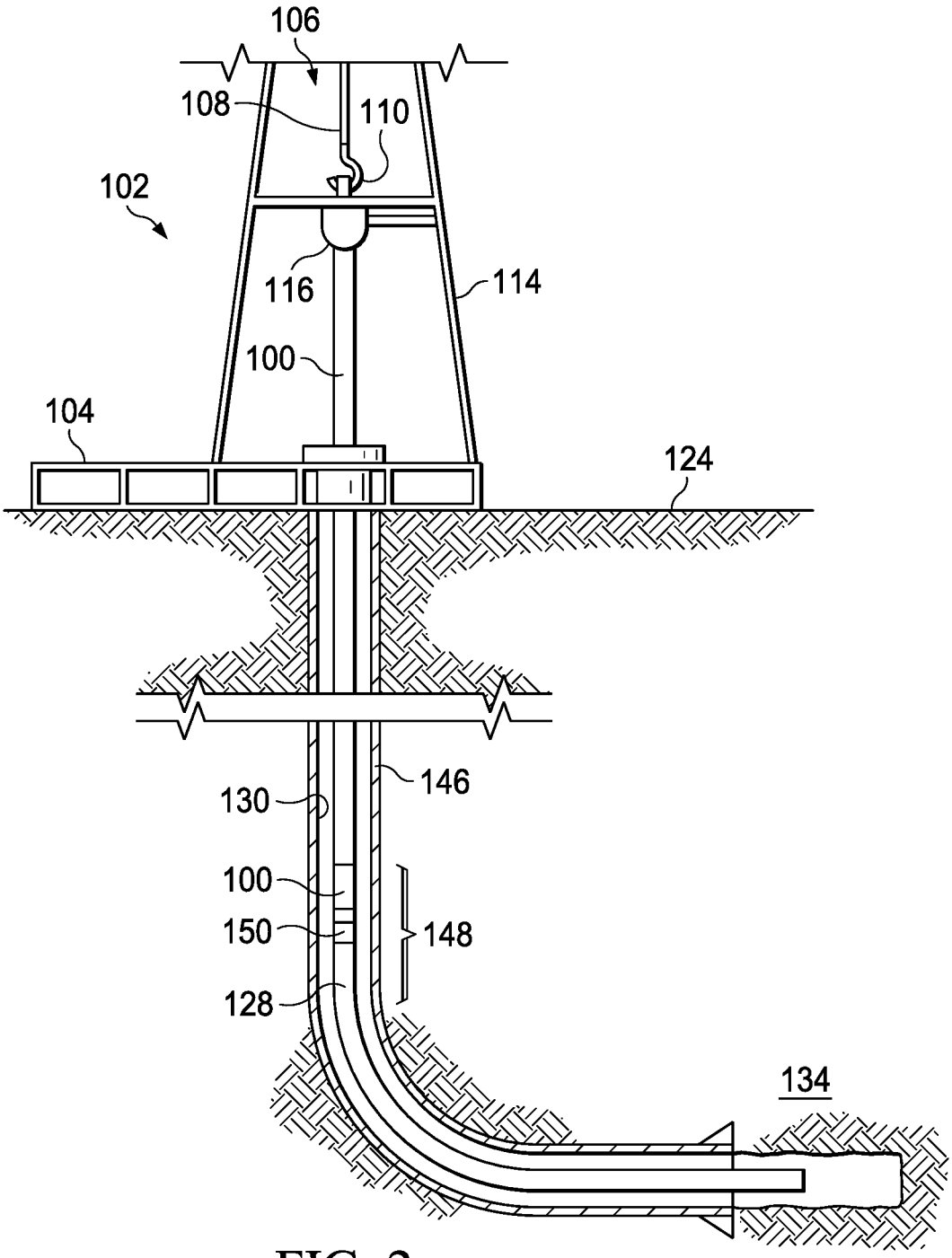
FIG. 2 illustrates a schematic view of an on-shore well in which a tool string is deployed according to an illustrative embodiment.

Alternatively, FIG. 2 illustrates a schematic view of a rig 104 in which a tool string 128 is deployed to a land-based well 102. The tool string 128 includes a diverter assembly 100 in accordance with an illustrative embodiment. The rig 104 is positioned at a surface 124 of a well 102. The well 102 includes a wellbore 130 that extends from the surface 124 of the well 102 to a subterranean substrate or formation. The well 102 and the rig 104 are illustrated onshore in FIG. 2.

FIGS. 1 and 2 each illustrate possible uses or deployments of the diverter assembly 100, which in either instance may be used in tool string 128 to apply a top-down squeeze operation and subsequently aid in the setting of a liner hanger or the utilization of another down hole device. In the embodiments illustrated in FIGS. 1 and 2, the wellbore 130 has been formed by a drilling process in which dirt, rock and other subterranean material has been cut from the formation by a drill bit operated via a drill string to create the wellbore 130. During or after the drilling process, a portion of the wellbore may be cased with a casing 146. From time to time, it may be necessary to deploy cement via the work string to form a casing in uncased zones 148 of the well above the casing 146. In some embodiments, the work string may be a liner running string. This is typically done in a top down squeeze operation in which cement is delivered to the wellbore through the work string and squeezed into the formation by diverting the cement to the annulus 136 between the wall of the wellbore 130 and tool and liner/casing string 128 and applying pressure.

The tool string 128 may refer to the collection of pipes, mandrels or tubes as a single component, or alternatively to the individual pipes, mandrels, or tubes that comprise the string. The diverter assembly 100 may be used in other types of tool strings, or components thereof, where it is desirable to divert fluid flow from an interior of the tool string to the exterior of the tool string. As referenced herein, the term tool string is not meant to be limiting in nature and may include a running tool or any other type of tool string used in well completion and maintenance operations. In some embodiments, the tool string 128 may include a passage disposed longitudinally in the tool string 128 that is capable of allowing fluid communication between the surface 124 of the well 102 and a downhole location 134.

The lowering of the tool string 128 may be accomplished by a lift assembly 106 associated with a derrick 114 positioned on or adjacent to the rig 104 or offshore platform 142. The lift assembly 106 may include a hook 110, a cable 108, a traveling block (not shown), and a hoist (not shown) that cooperatively work together to lift or lower a swivel 116 that is coupled an upper end of the tool string 128. The tool string 128 may be raised or lowered as needed to add additional sections of tubing to the tool string 128 to position the distal end of the tool string 128 at the downhole location 134 in the wellbore 130. A fluid supply source (not shown) may be used to deliver a fluid (e.g., a cement slurry) to the tool string 128. The fluid supply source may include a pressurization device, such as a pump, to deliver positively pressurized fluid to the tool string 128.

Figure 3:
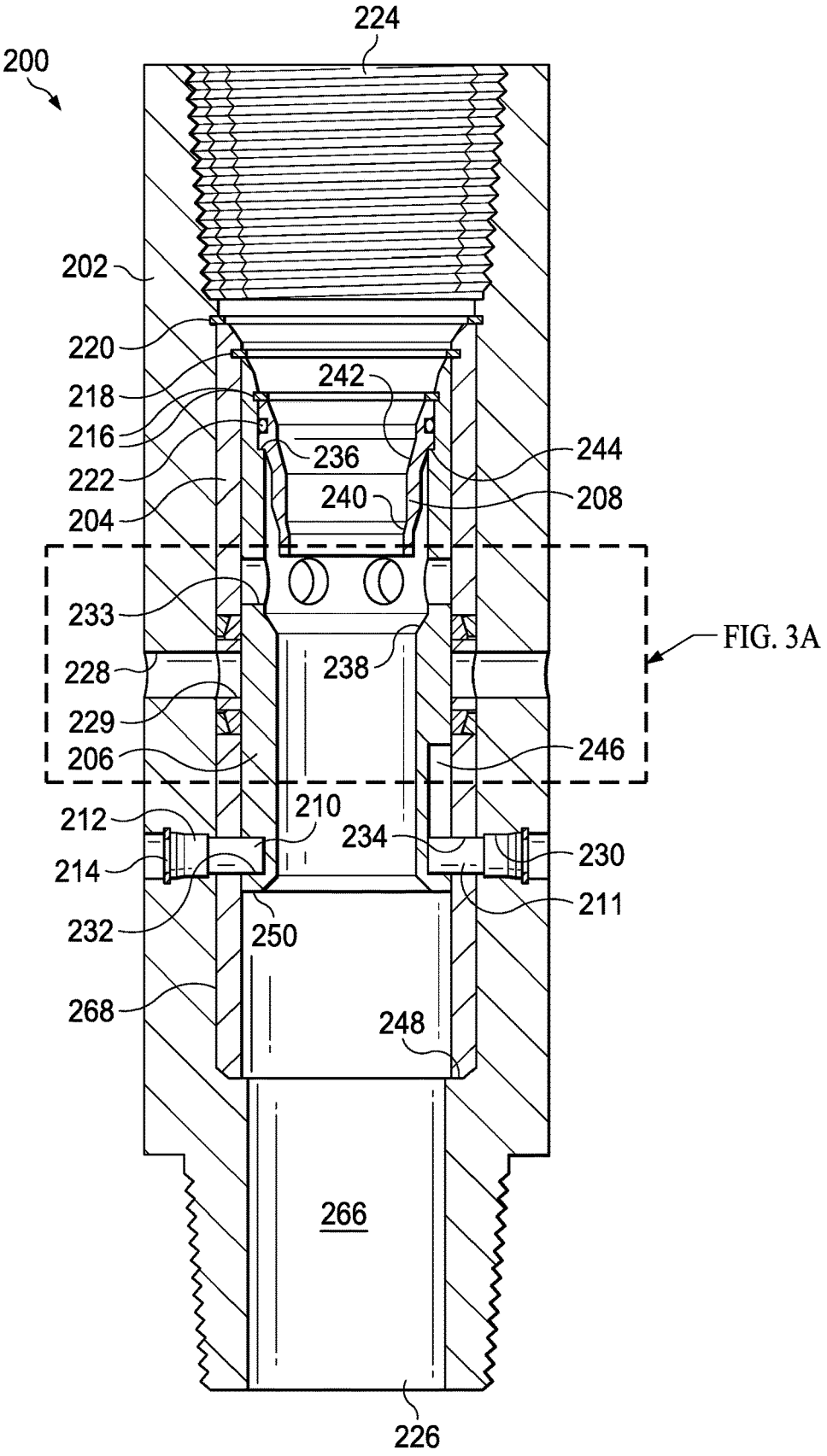
FIG. 3 illustrates a schematic, cross-section view of a diverter assembly.

An illustrative embodiment of a diverter assembly 200 is shown in FIG. 3. The diverter assembly 200 includes a tubing segment 202 that may be inserted between upper and lower sections of a tool string, or piping disposed therein. The tubing segment 202 has an inlet 224 at an uphole end and an outlet 226 at a downhole end. The tubing segment 202 may also have a primary bore 266 having a first diameter and a secondary bore 268 having a second diameter that is larger than the first diameter. The primary bore 266 transitions to the secondary bore 268 at a shoulder 248.

An outer sleeve 204 is positioned within the secondary bore 268 and has an outer diameter that allows the outer sleeve 204 to snugly fit within the secondary bore 268. The outer sleeve 204 has an inner diameter that is less than the diameter of the secondary bore 268 such that the shoulder 248 supports the base of the outer sleeve 204 and extends below the inner diameter of the outer sleeve 204. The outer sleeve 204 includes outer apertures (pin holes) 234 that align with aligning apertures (pin holes) 230 of the tubing segment 202. The outer sleeve 204 also includes apertures 229, shown as thru holes that align with tubing segment apertures 228, shown as thru holes, of the tubing segment 202 when the outer sleeve 204 is installed within the tubing segment 202. The tubing segment apertures 228 may be referred to as a first set of apertures. The outer sleeve 204 may be retained in place within the tubing segment 202 by an outer snap ring 220 that is secured within a groove formed in the secondary bore 268.

Figure 3A:
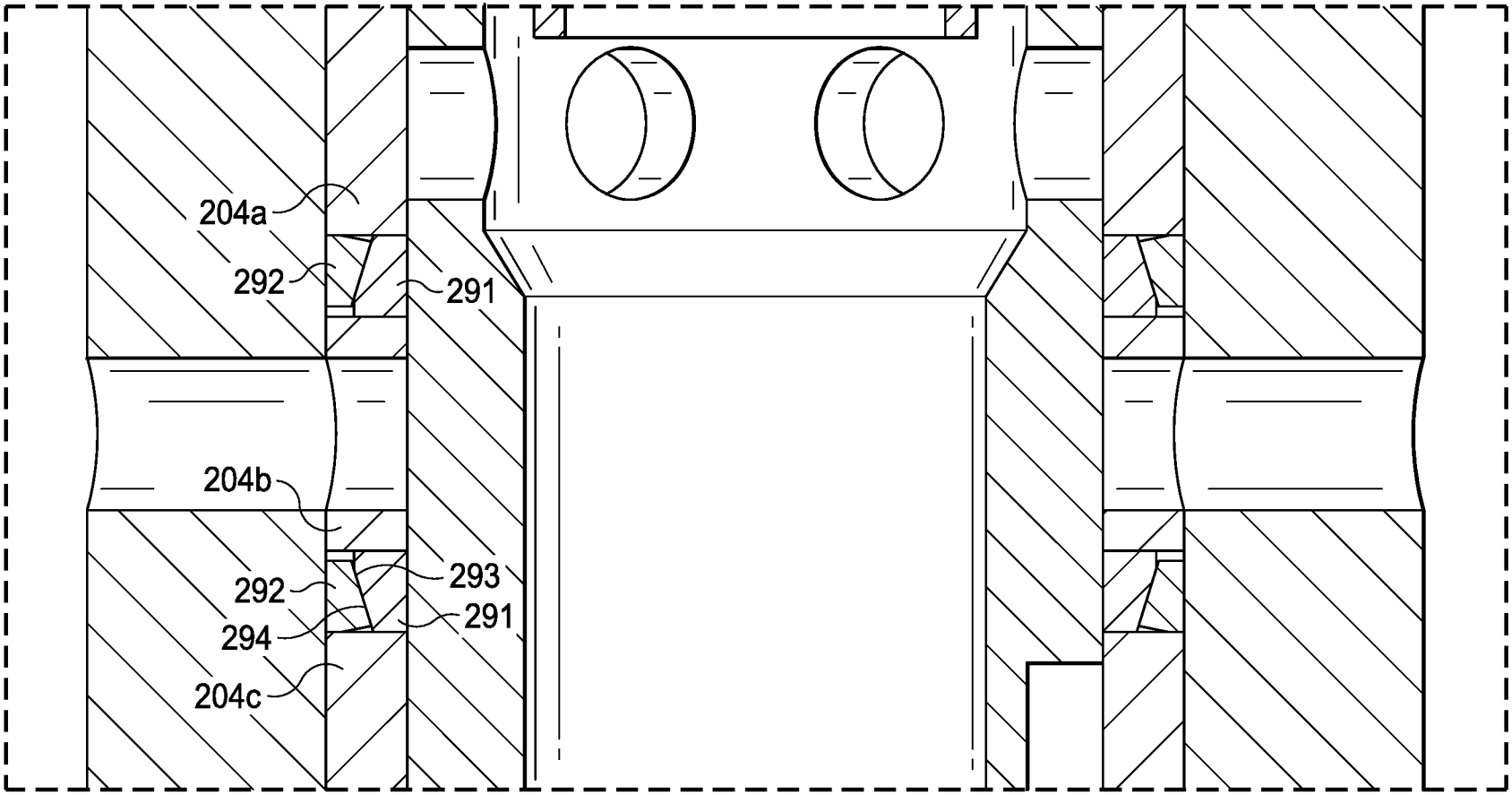
FIG. 3A illustrates a detail view of an outer sleeve of the diverter assembly of FIG. 3.

A detail view of the outer sleeve 204 is shown in FIG. 3A. As shown, the outer sleeve 204 may be formed by a plurality of parts. In the example shown, the outer sleeve 204 is formed by an upper outer sleeve 204*a*, an intermediate outer sleeve 204*c* that includes outer sleeve apertures 229, and a lower outer sleeve 204*c* that includes the slots 246 and outer pin holes 234. To form a fluid seal above and below the outer sleeve apertures 229, seals may be placed between the upper outer sleeve 204*a* and intermediate outer sleeve 204*b*, and between the intermediate outer sleeve 204*b* and lower outer sleeve 204*c*. The seals may include an inner sealing ring 291 and outer sealing ring 292 having a wedged interface to form a compressive seal on all four sides of the seal (above, below, inner circumference, and outer circumference). To generate vertical compression, the seals may be vertically compressed by the upper outer sleeve 204*a*, intermediate outer sleeve 204*b*, and lower outer sleeve 204*c*. To generate radial compression, the inner sealing ring 291 may have an outer wedged surface 293 and the outer sealing ring 292 may have a complementary inner wedged surface 294. In an embodiment, the wedged surfaces may be slightly dissimilar to provide a higher radial pressure at the higher pressure side of the seal and to provide for plastic flow and material elasticity. To that end the inner wedged surface 294 may have an angle of (for example) fifteen degrees (from vertical) and the outer wedged surface may have an angle of (for example) sixteen degrees, or vise versa. The arrangement of the wedged surfaces results in vertical compression of the inner sealing ring 291 toward the outer sealing ring 292 results in corresponding radial compression when inward movement of the inner sealing ring 291 is constrained by the intermediate sleeve 206 and outward movement of the outer sealing ring is constrained by the tubing segment 202. The inner sealing ring and outer sealing ring may be fabricated from polytetrafluoroethylene or any other suitable material.

Referring again to FIG. 3, in some embodiments, an intermediate sleeve 206 is positioned within the outer sleeve 204 such that the intermediate sleeve 206 may slide axially within the outer sleeve 204 if not axially constrained. To maintain the intermediate sleeve 206 in a first position, the intermediate sleeve 206 includes a first set of inner pin holes 232 that align with a first set of tube pin holes 230 and a first set of outer sleeve pin holes 234 such that one or more first shear pins 210 may be inserted through the holes to align the intermediate sleeve 206 within the diverter assembly 200 until a preselected force (corresponding to the shear strength of the first shear pins 210) is applied on the intermediate sleeve. In some embodiments, the first shear pins 210 may comprise a set of five shear pins. The intermediate sleeve 206 may be constrained from moving uphole within the diverter assembly 200 by an intermediate snap ring 218 that is secured within a groove formed in an inner diameter of the outer sleeve.

Figure 8:
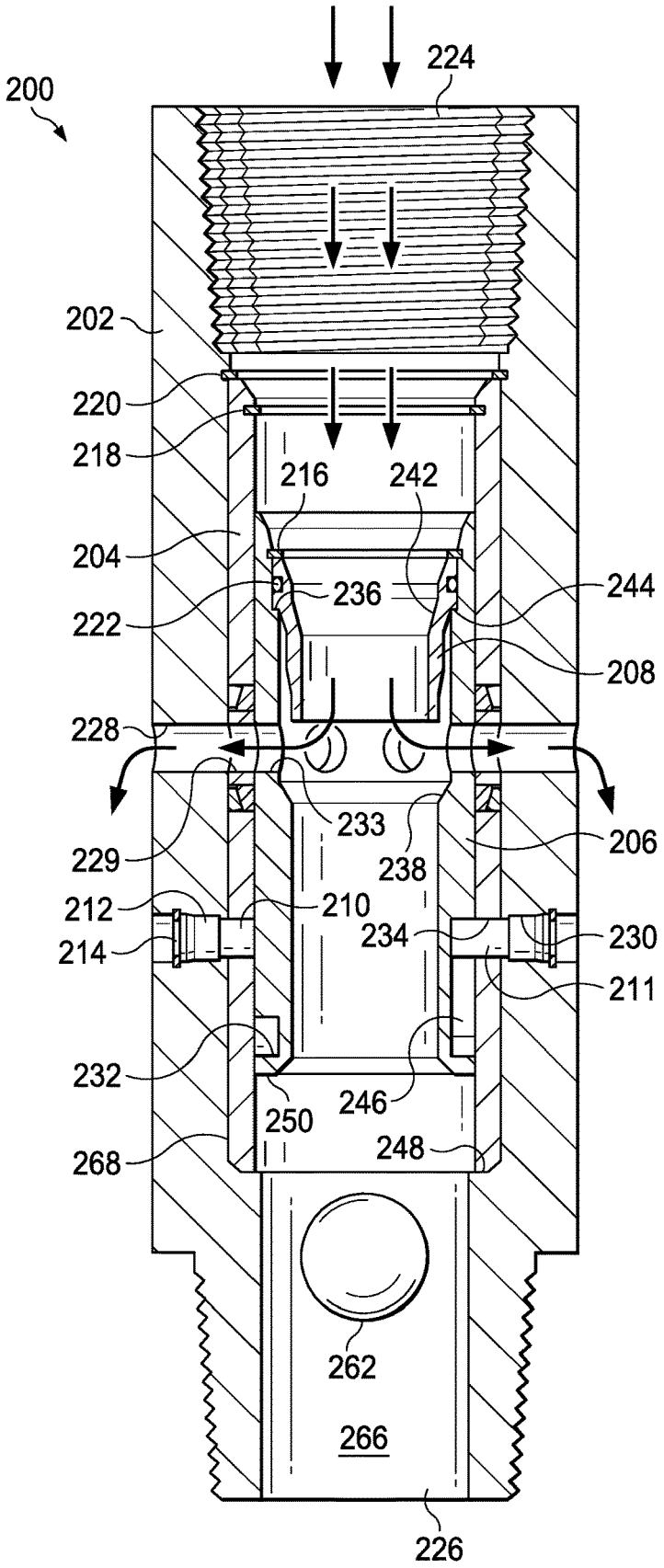
FIG. 8 illustrates a schematic, cross-section view of the diverter assembly of FIG. 3, after the first ball has been extruded through an inner sleeve.

The intermediate sleeve 206 includes sleeve apertures 233 that are arranged to align radially with the apertures 228, 229 of the outer sleeve 204 and tubing segment 202, respectively. The sleeve apertures 229 may be referred to as a second set of apertures. The sleeve apertures 233 are axially offset from the apertures 228, 229 when the intermediate sleeve 206 in is in the first position. The intermediate sleeve 206 further includes one or more slots 246 that align with a second set of tube pin holes 230 and a second set of outer sleeve pin holes 234 such that one or more second shear pins 211 may be inserted through the holes. It is noted that the positioning of the slots 246 and pin holes 232 shown in the figures are illustrative only and may be staggered such that the features would not actually appear in a common plain that crosses a central axis of the assembly. For example, the intermediate sleeve 206 may include four or more slots 246 and four or more pin holes 232, each spaced equidistantly about the perimeter of the intermediate sleeve 206 and offset from one another by approximately forty-five degrees (i.e., each slot would be spaced ninety degrees from the next slot). In some embodiments, the second shear pins 211 may comprise a set for five shear pins. The length of the slots 246 may be selected such that shearing of the first shear pins frees the intermediate sleeve 206 to slide in a downhole direction within the outer sleeve 204 until the top of the slot engages the second shear pins 211 in a second position, as described in more detail below with regard to FIG. 8. When the intermediate sleeve 206 is the in the second position, engagement between the slots 246 and second shear pins 211 prevent further downhole movement of the intermediate sleeve 206. The first shear pins 210 and second shear pins may be threaded into the diverter assembly and/or held in place by pin snap rings 214 and/or plugs 212.

As referenced herein, the shear pins may be understood to be frangible fastening mechanisms that temporarily fix components relative to one another until subjected to a shearing or breaking force. In some embodiments, the shear pins may be replaced by shear screws or other frangible fasteners. In other embodiments, one or more of the sets of shear pins may be replaced by a extrusion disk.

In some embodiments, an inner sleeve 208 is positioned within the intermediate sleeve 206. The inner sleeve 208 includes a plurality of seating surfaces, shown as first inner seat 240 and second inner seat 242. The wall thickness of the inner sleeve 208 may be tapered or graduated such that the material thickness at the first inner seat 240 is thinner than the wall thickness at the second inner seat 242. This stepped or tapered shape also provides for the outer surface of the inner sleeve 208 forming an inner shoulder 244 that rests on a first intermediate shoulder 236 of the intermediate sleeve 206 when the inner sleeve 208 is in an unactuated position. In the unactuated position, the inner sleeve 208 may be constrained from moving downhole by the engagement of the inner shoulder 244 with the first intermediate shoulder 236. The first inner seat 240 and second inner seat 242 may be sized and configured to a first actuating ball and second actuating ball, respectively but may alternatively be sized and configured to receive darts or other similar objects, which may be referred to herein as occluding members. The inner sleeve 208 may be constrained from moving uphole within the diverter assembly 200 by an inner snap ring 216 that engages a groove formed within the inner surface of the intermediate sleeve.

Figure 4:
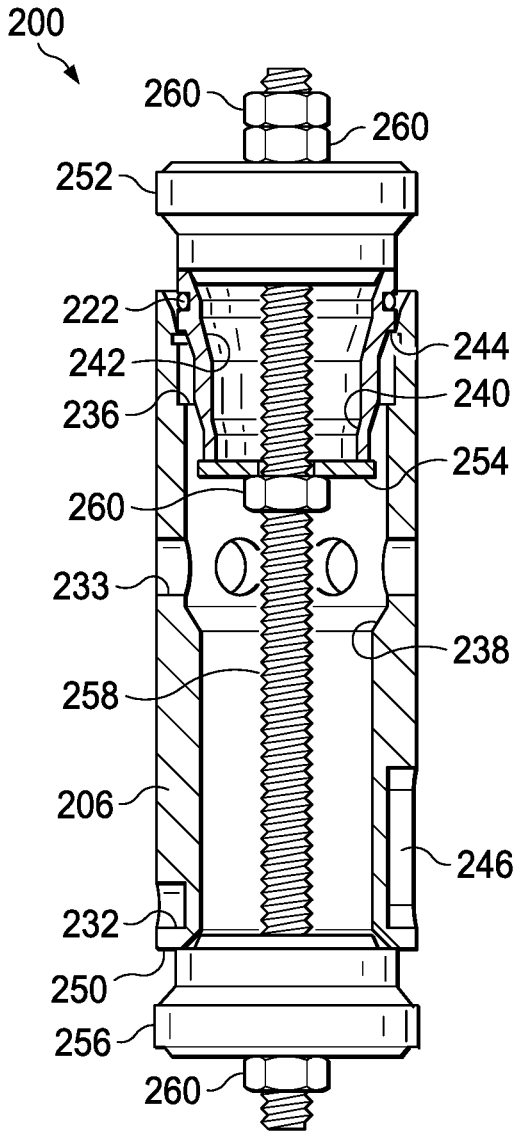
FIG. 4 illustrates a schematic, cross-section view of a portion of the diverter assembly of FIG. 3, with components of an assembly jig.
Figure 5:
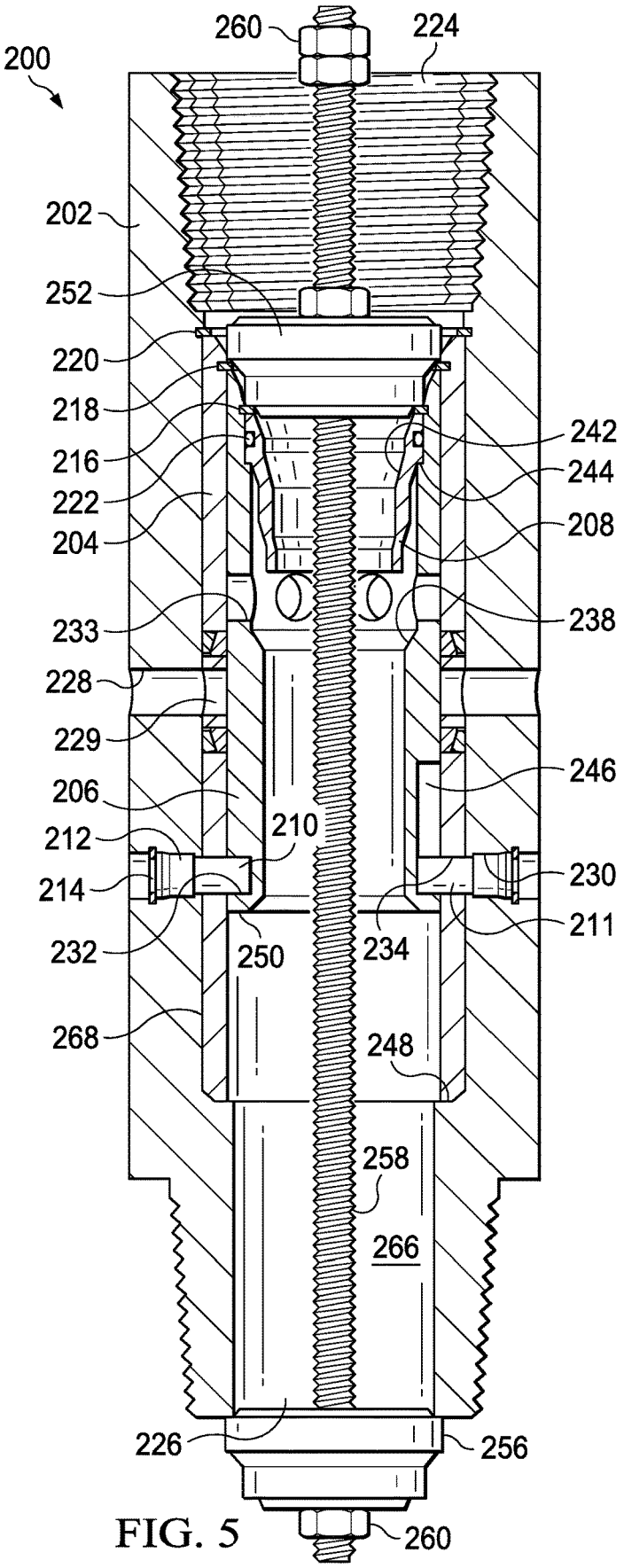
FIG. 5 illustrates a schematic, cross-section view of the diverter assembly of FIG. 3, with components of an assembly jig.

A system and method for assembling the diverter assembly 200 is shown in FIGS. 4 and 5. To insert the inner sleeve 208 within the intermediate sleeve, as shown in FIG. 4, a top aligning tool, which may be a generally circular upper aligning tool 252 having a tapered surface to align the upper aligning tool 252 and inner sleeve 208 along a common axis. A threaded rod 258 may be inserted through the upper aligning tool 252 and inner sleeve 208, and secured against a top surface of the upper aligning tool 252 by one or more jam nuts 260. A seal 222, such as an o-ring, v-seals, or similar sealing arrangement may be positioned within a groove of the inner sleeve 208 to prevent slippage and provide a sealed interface between the inner sleeve 208 and intermediate sleeve 206.

To secure the inner sleeve 208 against the upper aligning tool 252, an intermediate aligning tool 254 having similar aligning features to those of the upper aligning tool 252 is compressed toward the upper aligning tool 252 by an additional nut 260 engaged with the threaded rod 258. A lower aligning tool 256, having similar aligning features to those of the upper aligning tool 252, is configured to align with a base 250 of the intermediate sleeve 206. A nut 260 is threaded onto the threaded rod 258 below the lower aligning tool 256 and tightened to draw the rod downward and, correspondingly, to draw the inner sleeve 208 into the intermediate sleeve 206 until the first inner shoulder 244 of the inner sleeve 208 engages the first intermediate shoulder 236 of the intermediate sleeve 206.

To install the intermediate sleeve 206 within the outer sleeve 204, a pin 210 or similar aligning device may be temporarily installed to fix the lower outer sleeve 204*c* (shown in FIG. 3A) relative to the intermediate sleeve 206. The remaining component parts of the outer sleeve 204 (e.g., a lower outer sealing ring 292, a lower inner sealing ring 291, the intermediate outer sleeve 204*b*, an upper inner sealing ring 291, an upper outer sealing ring 292, and the upper outer sleeve 204*a*) may then be sequentially assembled to the lower outer sleeve 204*c* over the intermediate sleeve 206. To install the outer sleeve 204 within the tubing segment 202, the intermediate aligning tool 254 may be removed and the lower aligning tool 256 may be flipped over so that a second aligning surface engages the outlet of the tubing segment 202. Next, the nut 260 engaging the outer surface of the lower aligning tool 254 may be turned to draw the threaded rod 258 downward. Drawing the threaded rod 258 downward forces the intermediate sleeve 206 downward within the outer sleeve 204 until the outer pin holes 234 and inner pin holes 232 are aligned with the tubing pin holes 230, thereby resulting in the intermediate sleeve 206 being in the first position and the inner sleeve 208 being in the unactuated position.

Figure 6:
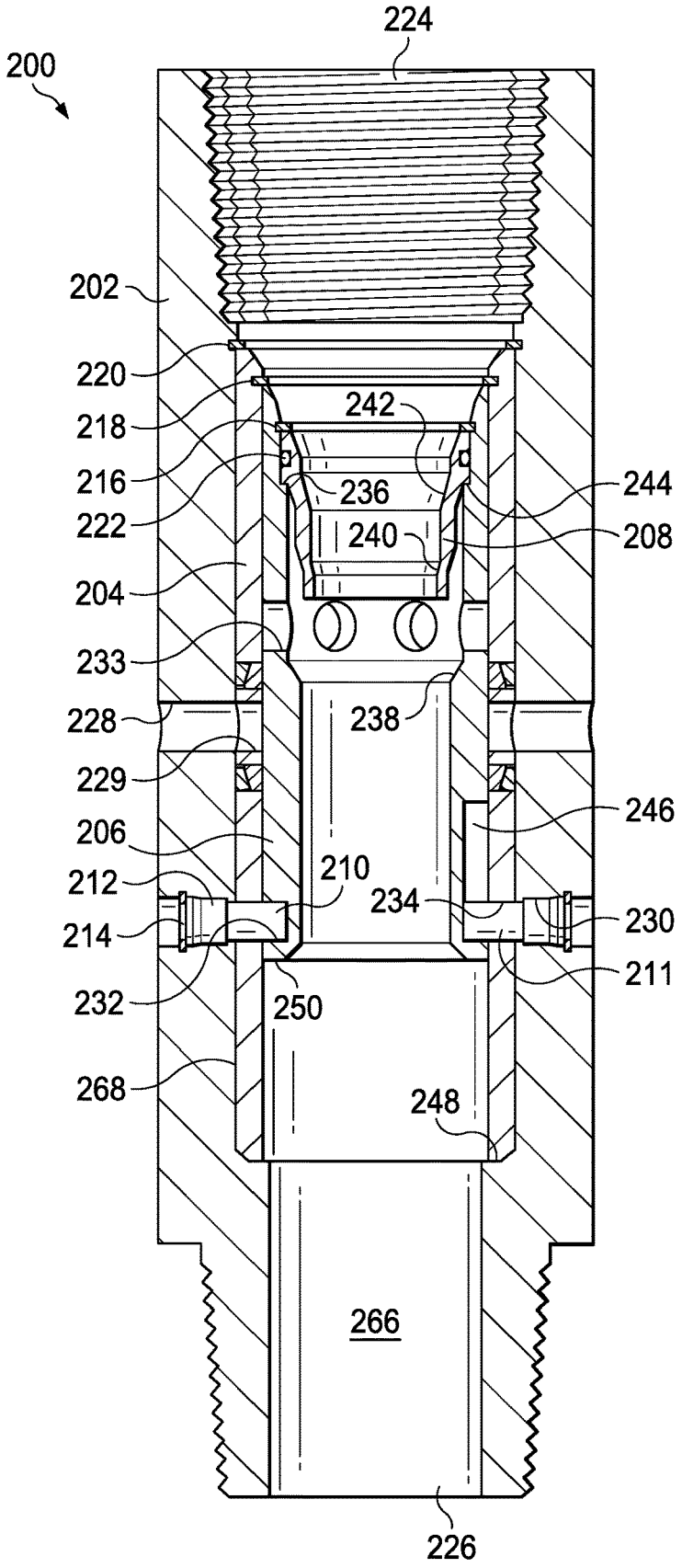
FIG. 6 illustrates a schematic, cross-section view of the diverter assembly of FIG. 3, in a run-in configuration.
Figure 7:
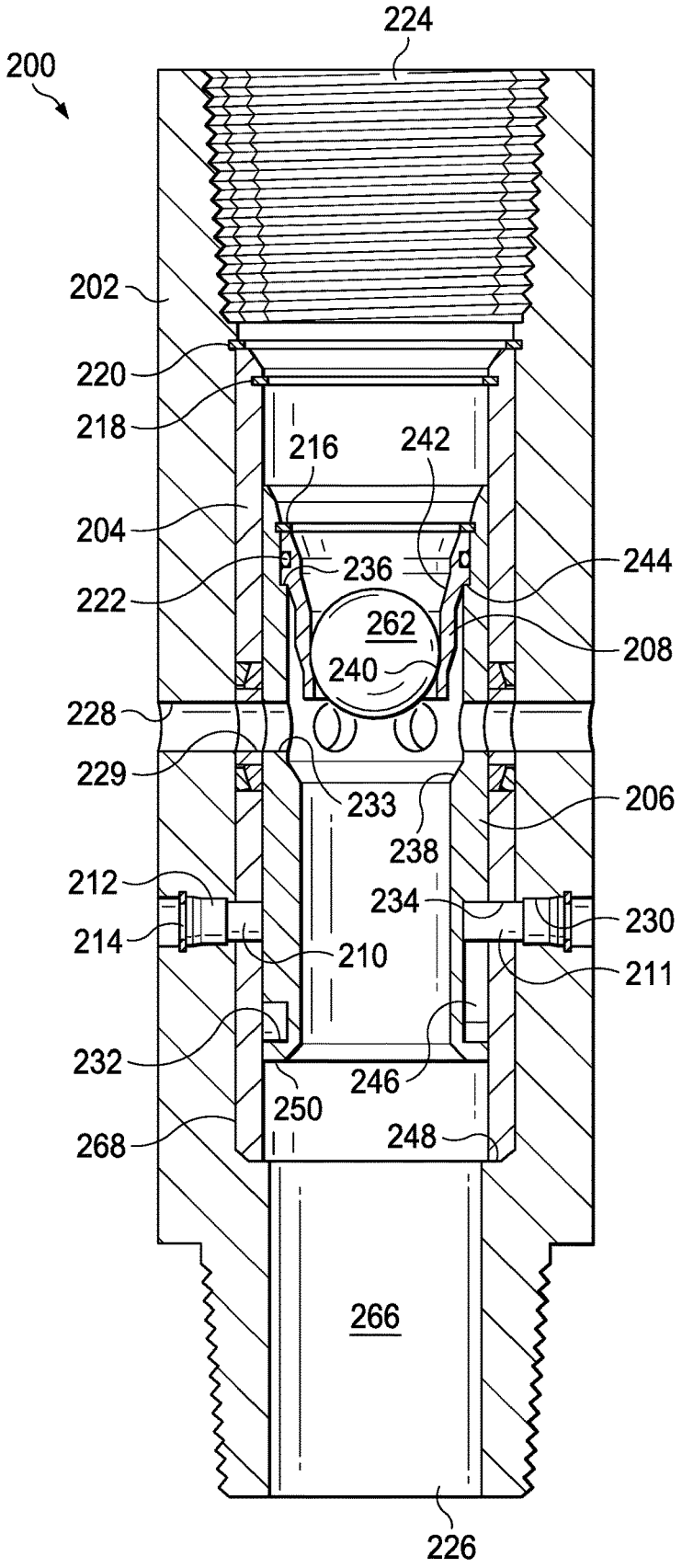
FIG. 7 illustrates a schematic, cross-section view of the diverter assembly of FIG. 3, shown here having received a first ball and wherein an intermediate sleeve has moved to a second position to open apertures of the diverter assembly.

A method of operating the diverter assembly 200 is shown in sequential steps in FIGS. 6-10. FIG. 6 shows the diverter assembly 200 in an unactuated state in which the inner sleeve 208 is in an unactuated position and in the intermediate sleeve is in the first position. To actuate the diverter assembly 200, a first ball 262 is dropped into the diverter assembly 200, as shown in FIG. 7. The first ball 262 lands on the first inner seat 240 of the inner sleeve 208. The inner seat 240 may also be referred to as an extrudable seat. The landing of the first ball 262 on the first inner seat 240 prevents fluid from flowing through the diverter assembly 200 and allowing a pressure differential to increase to a first pressure in the tool string at the diverter assembly 200. The first pressure may be, for example, on the order of 500-600 psi.

When the differential pressure in the tool string above the first ball 262 reaches a predetermined threshold (e.g., the first pressure), the hydrostatic plus necessary applied pressure exerted on the inner sleeve 208 exceeds the shear strength of the first shear pins 210, thereby freeing the intermediate sleeve 206 to slide downhole within the outer sleeve 204 to the second position in which the upper end of the slots 246 engage the second shear pins 211 to prevent the intermediate sleeve 206 from sliding further downhole.

As noted above and as shown in FIG. 8, the sleeve apertures 233 are aligned with tubing segment apertures 228 and outer sleeve apertures 229 to allow fluid to flow through the diverter assembly 200 to the annulus between the tool string and wellbore wall. The differential pressure at the inlet 224 (relative to the outlet) may be increased to a second pressure that is greater than the first pressure (for example, 1500 psi) to cause the first ball 262 to extrude through the first inner seat 240. In some embodiments, the first ball 262 may land on a valve seat downhole from the diverter assembly 200, or an alternative fluid flow restriction device may be actuated downhole from the diverter assembly 200, to restrict downhole flow through the annulus during a squeeze operation.

Figure 9:
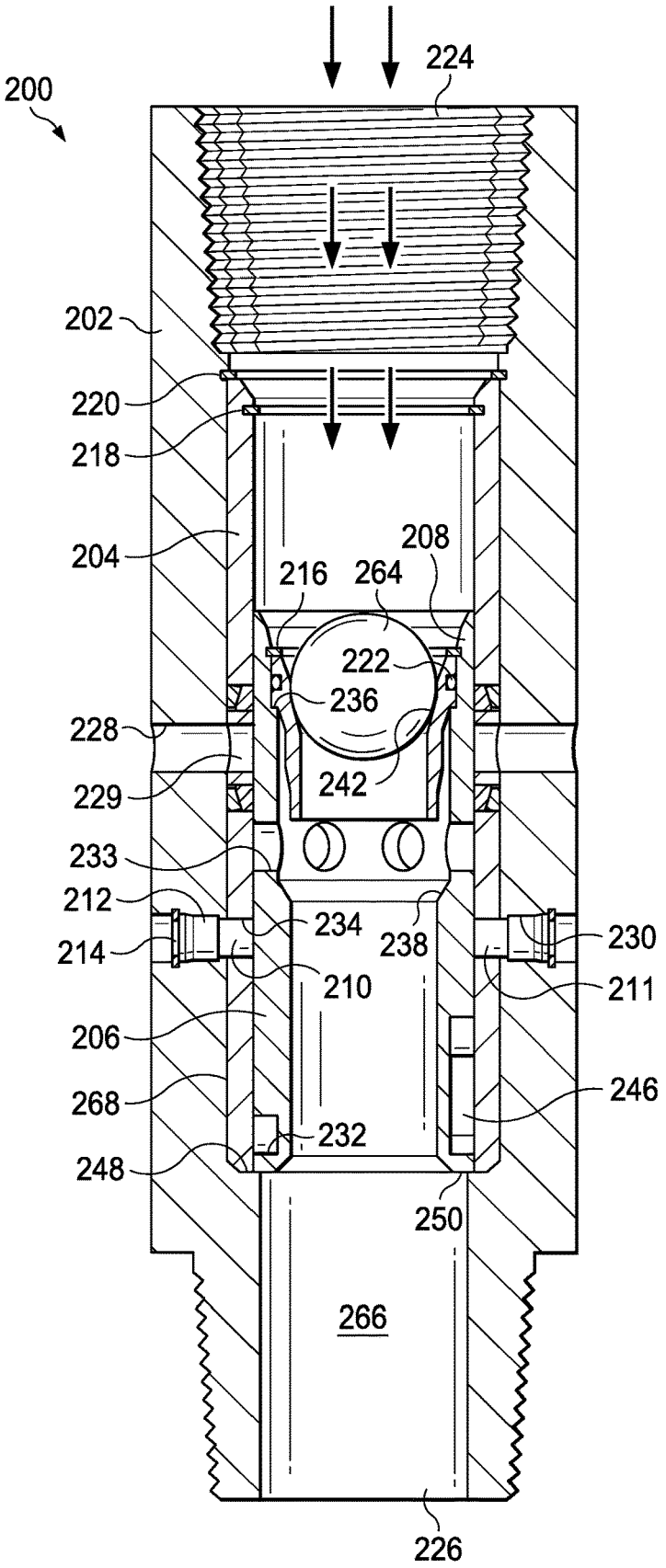
FIG. 9 illustrates a schematic, cross-section view of the diverter assembly of FIG. 3, shown here having received a second ball and wherein the intermediate sleeve has moved to a third position to close the apertures of the diverter assembly.

Following completion of the squeeze operation, a second ball 264 may be deployed into the tool string to land on the second inner seat 242 of the inner sleeve 208, as shown in FIG. 9. The first ball 262 may be smaller than the second ball 264 such that the first ball 262 will flow past the second inner seat 242 without pressure-induced extrusion. For example, the first ball 262 may have a diameter of 2.6 inches and the second ball 264 may have a diameter of 2.75 inches.

After the second ball 264 has landed on the second inner seat 242, the pressure differential may be increased to a second predetermined threshold above the landed ball. The pressure corresponding to the second predetermined threshold may be, for example, 2500 psi. When the differential pressure in the tool string at the second ball 264 reaches the second predetermined threshold, the hydrostatic force exerted on the inner sleeve 208 exceeds the shear strength of the second shear pins 211, thereby freeing the intermediate sleeve 206 to slide further downhole within the outer sleeve 204 to a third position in which a base 250 of the intermediate sleeve 206 engages the outer shoulder 248 of the tubing segment 202.

When the intermediate sleeve 206 moves from the second position to the third position, the sleeve apertures 233 are misaligned with tubing segment apertures 228 and outer sleeve apertures 229, thereby restricting fluid flow through the diverter assembly 200 to the annulus.

Figure 10:
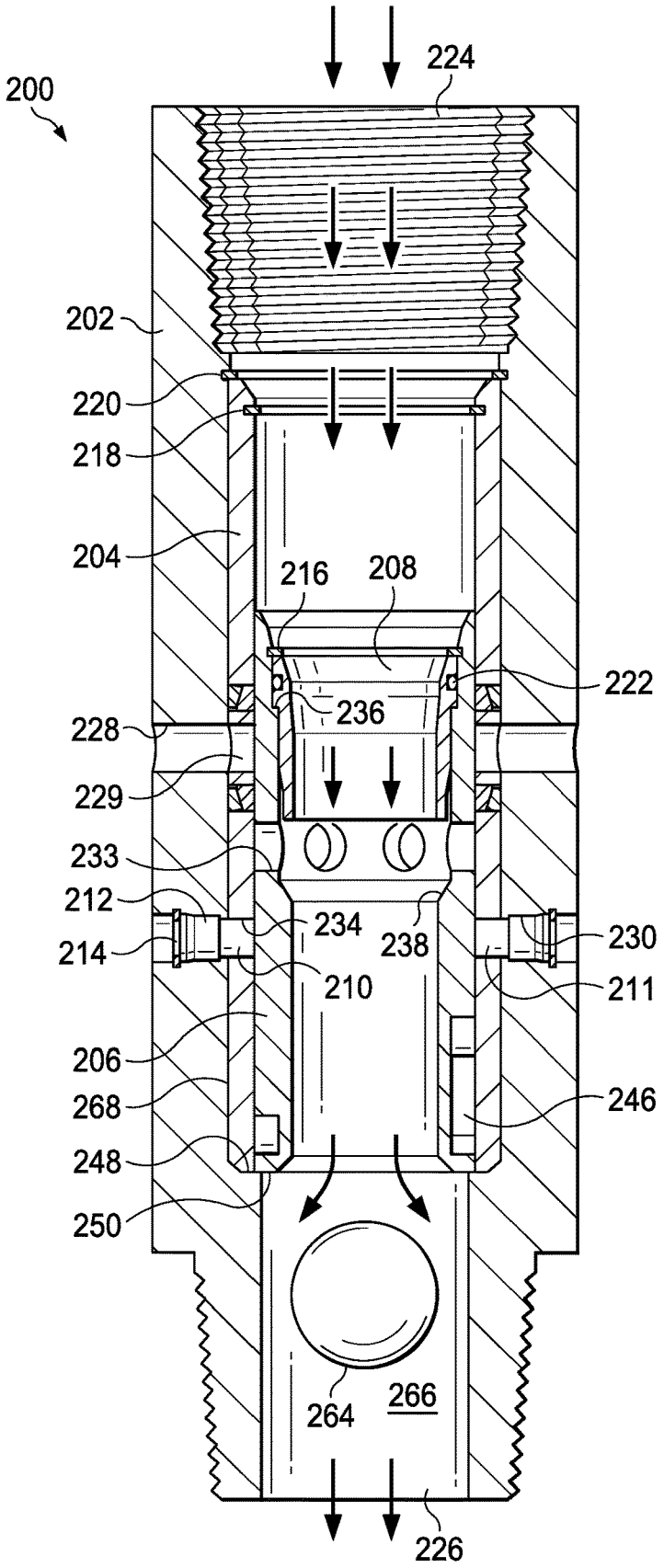
FIG. 10 illustrates a schematic, cross-section view of the diverter assembly of FIG. 3, after the second ball has been extruded through the inner sleeve.

To re-establish downhole flow through the diverter assembly 200, the differential pressure may be further increased to force the second ball 264 across the second inner seat 242, thereby permitting downhole flow through the tool string, as shown in FIG. 10. Following extrusion across the second inner seat 242, the second ball 264 may be used to trigger a second tool (e.g., a liner hanger) downhole from the diverter assembly 200.

Figure 11:
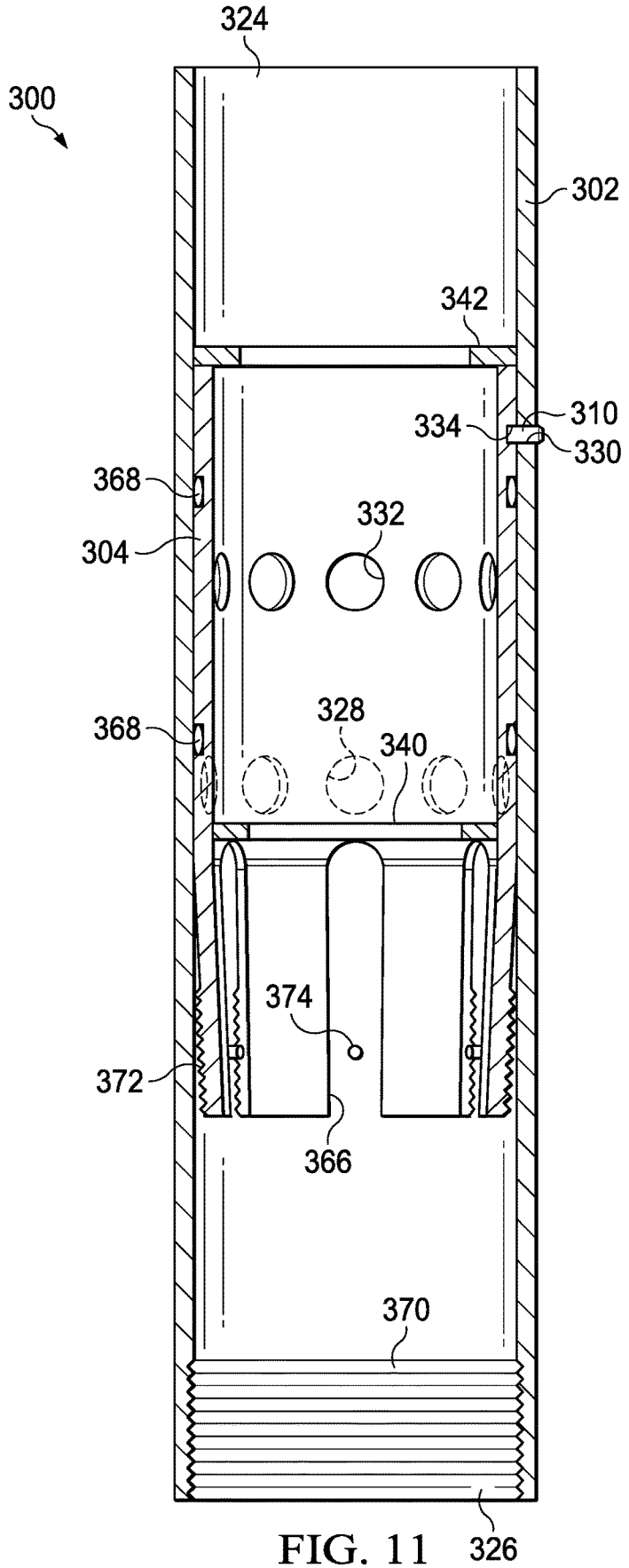
FIG. 11 illustrates a schematic, cross-section view of an embodiment of a diverter assembly in a run-in configuration.

A second embodiment of a diverter assembly 300 is described with regard to FIGS. 11-17. It is noted, however, features of each embodiment may be employed in alternate embodiments without departing from the scope of this disclosure. In the embodiment of FIG. 11, a diverter assembly 300 is shown that includes a tubing segment 302. The tubing segment 302 is shown as being generally cylindrical and having an inlet 324 that may be coupled to an uphole tubing segment and outlet that may be coupled to a downhole tubing segment. One or more tubing segment apertures 328 (first apertures) are formed within the tubing segment 302 to provide a pass from the inner bore to the annulus between the tubing segment 302 and wellbore wall.

Figure 13:
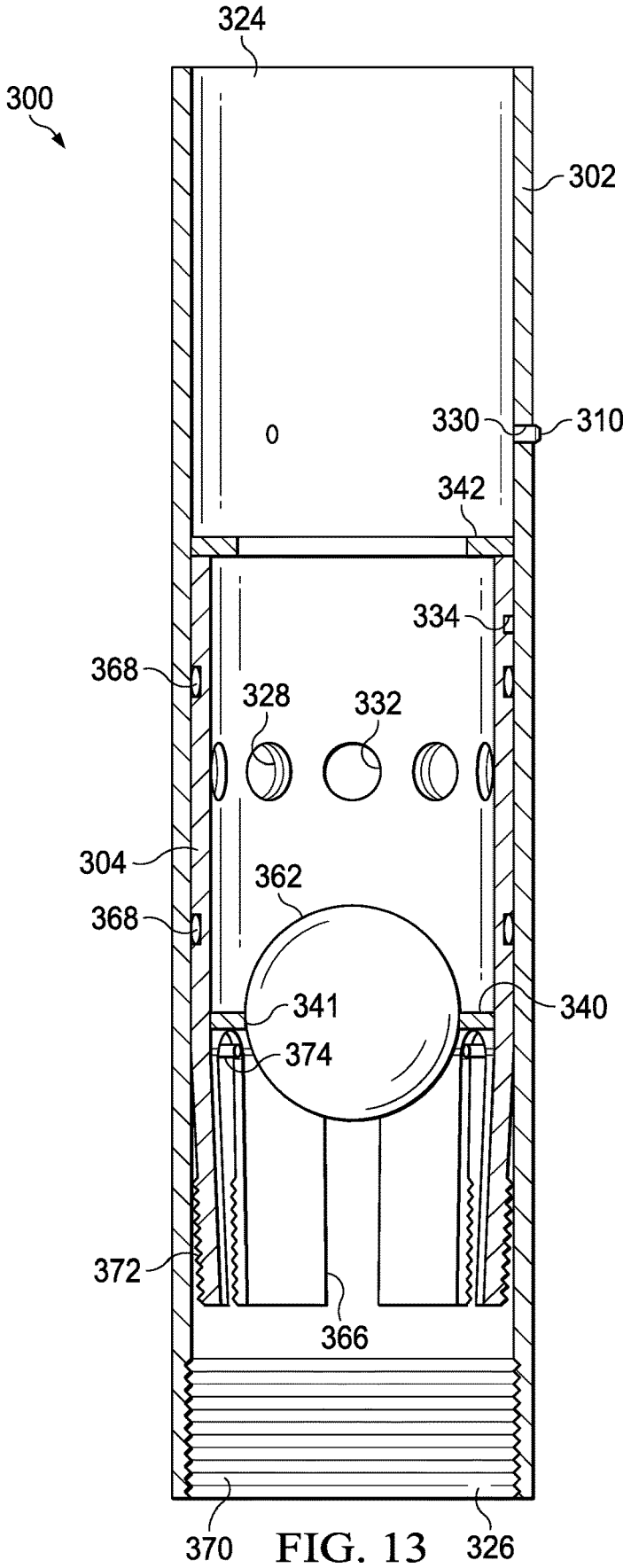
FIG. 13 illustrates a schematic, cross-section view of the diverter assembly of FIG. 11, after an inner sleeve of the diverter assembly has moved from a first position to a second position to open apertures of the diverter assembly.
Figure 15:
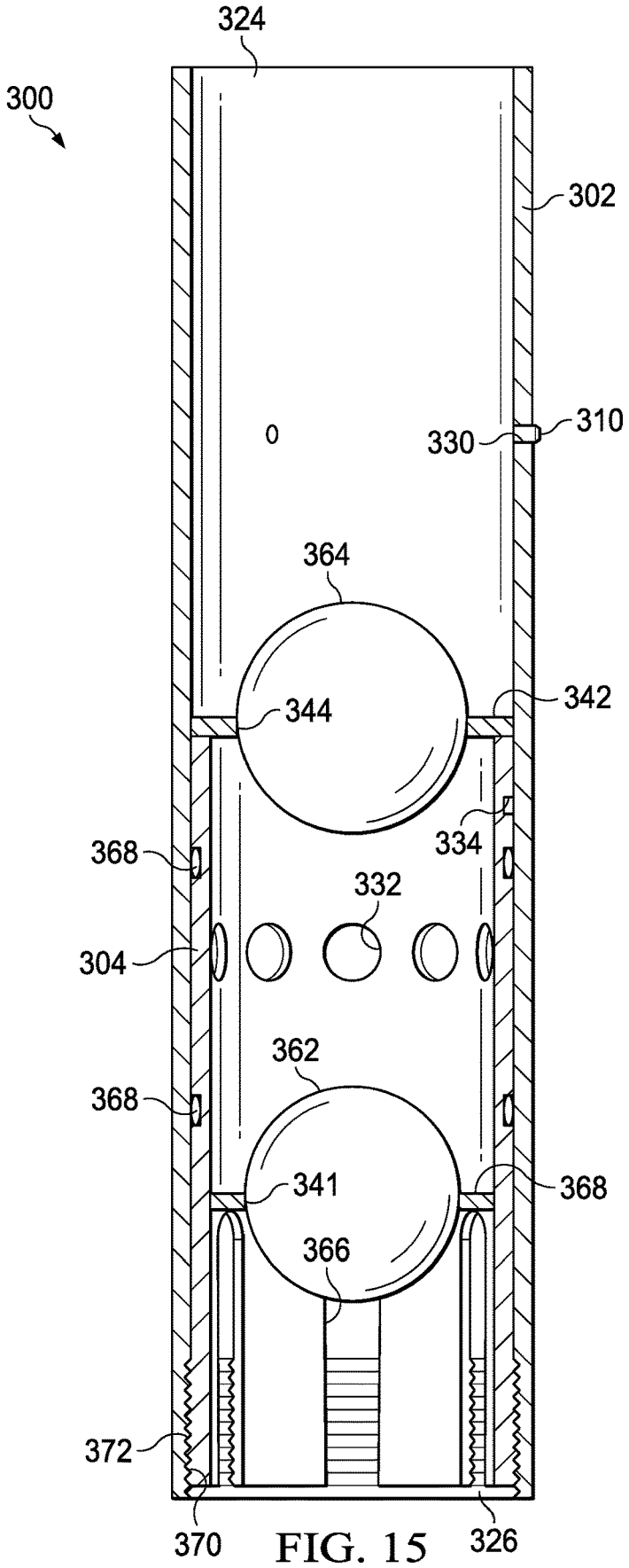
FIG. 15 illustrates a schematic, cross-section view of the diverter assembly of FIG. 11, after the inner sleeve of the diverter assembly has moved from the second position to a third position to close the apertures of the diverter assembly.

A sleeve 304 is positioned within the bore of the tubing segment 302 and may include one or more seals 368 to provide a sealed interface between the inner bore of the tubing segment 302 and the external surface of the sleeve 304. The sleeve 304 is operable to move from a first position, as shown in FIG. 11, to a second position, as shown in FIG. 13, and a third position, as shown in FIG. 15. The sleeve 304 may held in the first position by one or more first shear pins 310 extending pin holes 330 formed in the tubing segment 302 into sleeve pin holes 334 formed in the sleeve 304. The sleeve 304 further includes one or more sleeve apertures 332 (second apertures) that are axially offset from (and misaligned with) the tubing segment apertures 328 of the tubing segment 302 when the sleeve 304 is in the first position.

The sleeve 304 is operable to slide axially downhole within the tubing string when actuated from the first position to the second position. To that end, the sleeve 304 includes one or more slots 366 that align with one or more second shear pins 374 and are sized such the ends of the slots 366 engage the second shear pins 374 when the sleeve 304 is in the second position to arrest further downhole movement of the sleeve 304. The downhole portion of the sleeve 304 may include sleeve retaining features 372 such as teeth or other gripping features. The tubing segment may correspondingly include second retaining features 370 to engage the sleeve retaining features 372 and retain the sleeve 304 in the third position when the sleeve retaining features 372 engage the second retaining features 370. When the intermediate sleeve 306 is the in the second position, engagement between the slots 346 and second shear pins 311 prevent further downhole movement of the intermediate sleeve 306. The first shear pins 310 and second shear pins may be threaded into the diverter assembly and/or held in place by pin snap rings 314 and/or plugs 312.

To facilitate actuation of the diverter assembly 300, a first extrusion disk 340 and second extrusion disk 342 may be coupled to the sleeve 304. The first extrusion disk 340 and second extrusion disk 342 may be axially offset from one another such that the first extrusion disk is positioned below the sleeve apertures 332 and the second extrusion disk 342 is positioned above the sleeve apertures 332.

Figure 12:
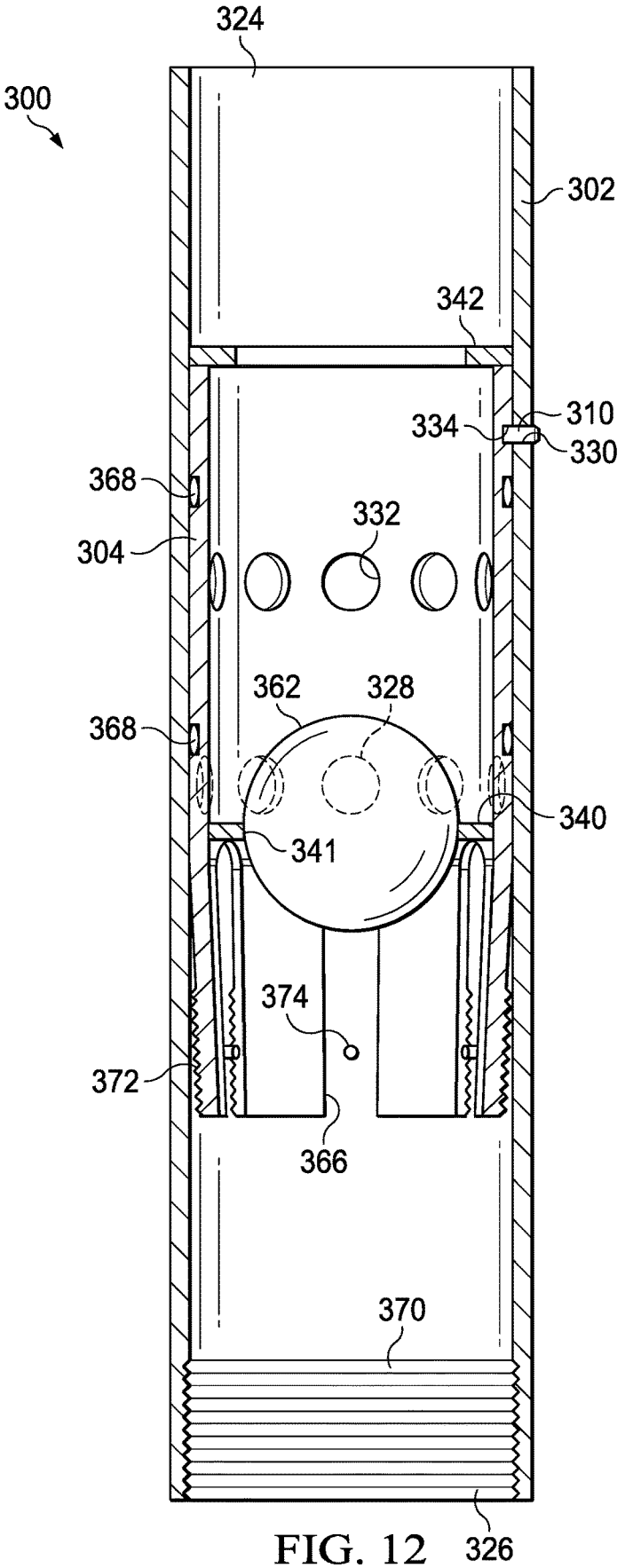
FIG. 12 illustrates a schematic, cross-section view of the diverter assembly of FIG. 11, shown here having received a first ball.

A method of operating the diverter assembly 300 is shown in sequential steps in FIGS. 11-17. The diverter assembly 300 is deployed into a wellbore as a subassembly of a tool string with the sleeve 304 in the first position, as shown in FIG. 11. To actuate the diverter assembly 300, a first ball 362 is dropped into the diverter assembly 200, as shown in FIG. 12. The first ball 262 lands on a first seat 341 of the first extrusion disk 340, thereby preventing fluid from flowing through the diverter assembly 300 and allowing pressure to increase in the tool string above the diverter assembly 300. When the differential pressure in the tool string above the first ball 362 reaches a predetermined threshold, the applied pressure exerted on the sleeve 304 exceeds the shear strength of the first shear pins 310, thereby freeing the sleeve 304 to slide downhole within the tubing segment 302 to the second position in which the upper end of the slots 366 engage the second shear pins 311 to prevent the sleeve 304 from sliding further downhole, as shown in FIG. 13.

When the sleeve 304 is in the second position, the sleeve apertures 332 are aligned with tubing segment apertures 328 to allow fluid to flow through the diverter assembly 300 to the annulus between the tool string and wellbore wall. The first ball 362 may remain landed on the first seat 341, thereby forcing fluid flowing from the tool string to the inlet 324 into the annulus via the diverter assembly 300 to enable a top-down squeeze operation.

Figure 14:
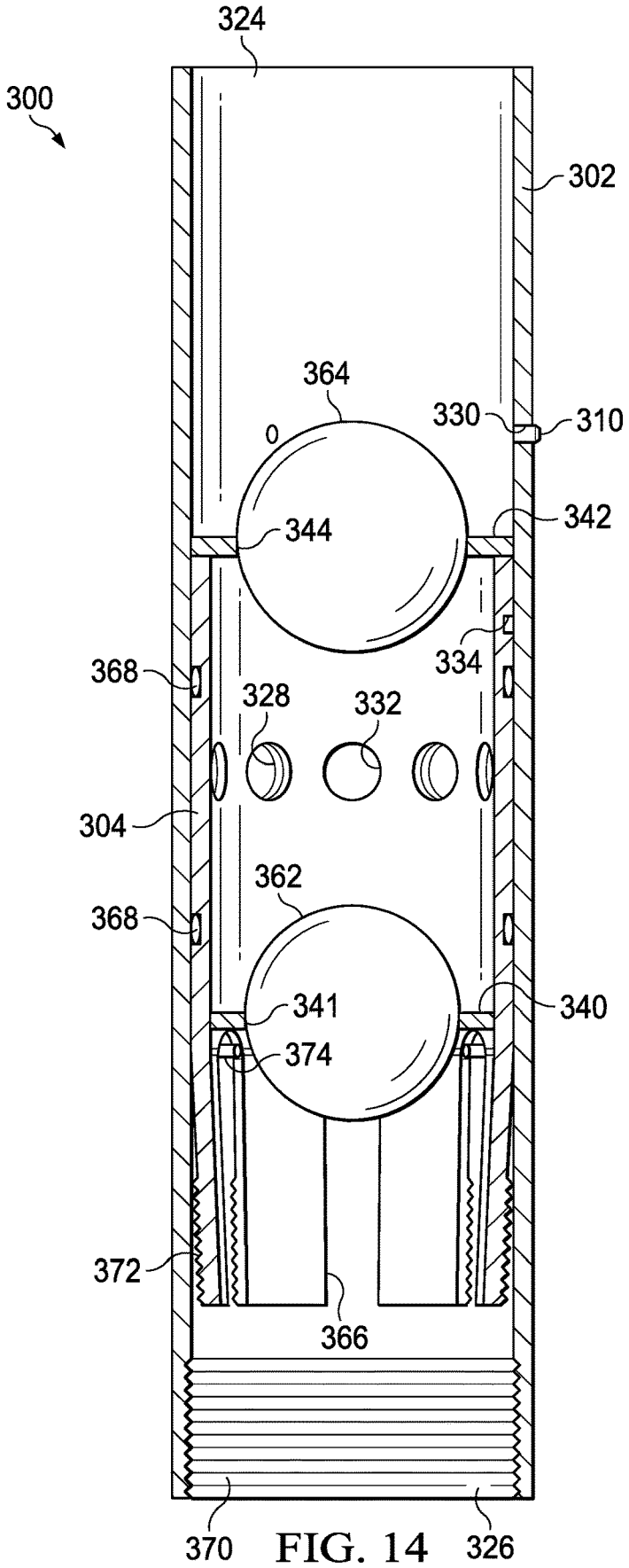
FIG. 14 illustrates a schematic, cross-section view of the diverter assembly of FIG. 11, shown here having received a second ball.

Following completion of the squeeze operation, pressure may be increased to resume flow through the tool string and a second ball 364 may be deployed into the tool string to land on a second seat 344 of the second extrusion disk 342, as shown in FIG. 14. After the second ball 364 has landed on the second seat 344, differential pressure within the tool string may be increased to a second predetermined threshold at the inlet 324. When the hydrostatic above the second ball 364 reaches the second predetermined threshold, the hydraulic force exerted on the sleeve 304 via the second ball 364 and second extrusion disk 342 exceeds the shear strength of the second shear pins 311, thereby freeing the sleeve 304 to slide further downhole within the tubing segment 302 to a third position in which the inner retaining teeth (sleeve retaining features 372) of the sleeve 304 engage the outer retaining teeth (second retaining features) 370 of the tubing segment 302.

When the sleeve 304 moves from the second position to the third position, as shown in FIG. 15 the sleeve apertures 332 are misaligned with tubing segment apertures 328, thereby restricting fluid flow through the diverter assembly 300 to the annulus. At this stage, additional pressure may be applied to the tool string uphole from the diverter assembly 300 to actuate a tool, such as a liner hanger.

Figure 16:
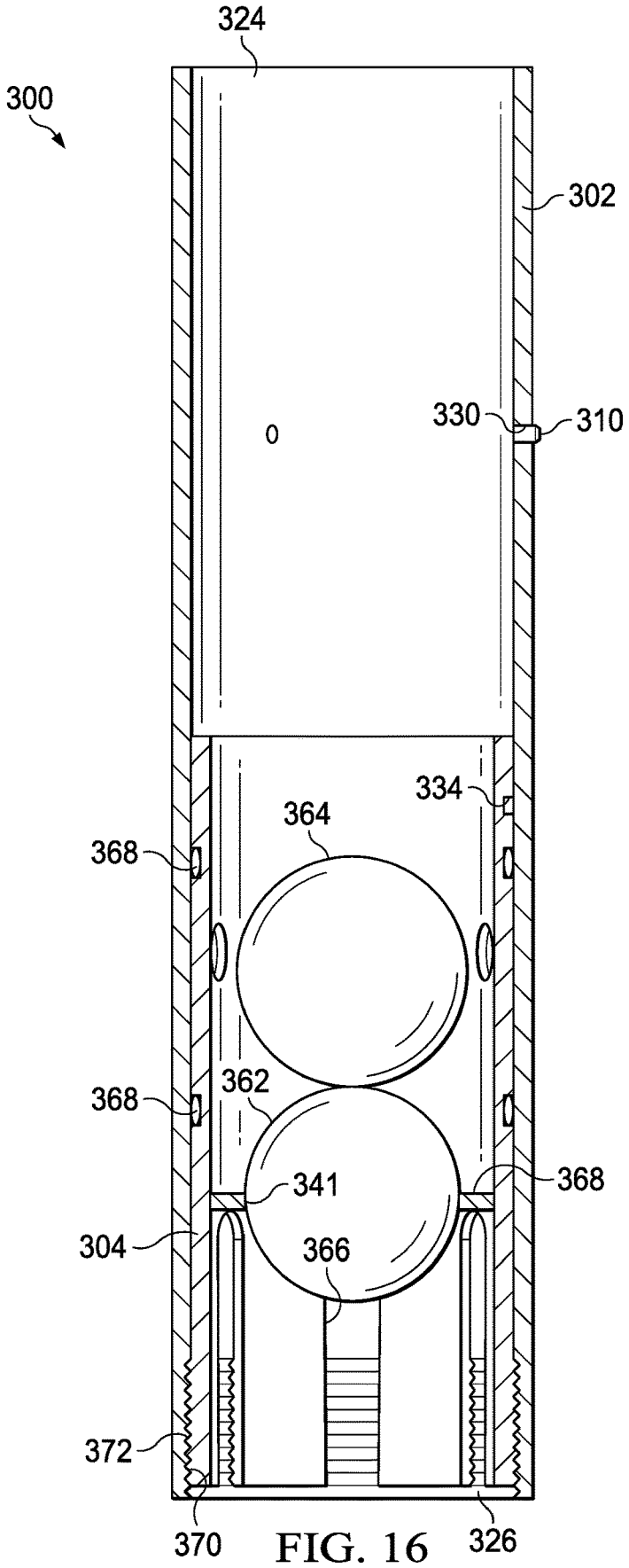
FIG. 16 illustrates a schematic, cross-section view of the diverter assembly of FIG. 11, after the second ball has been extruded through a second extrusion disk.
Figure 17:
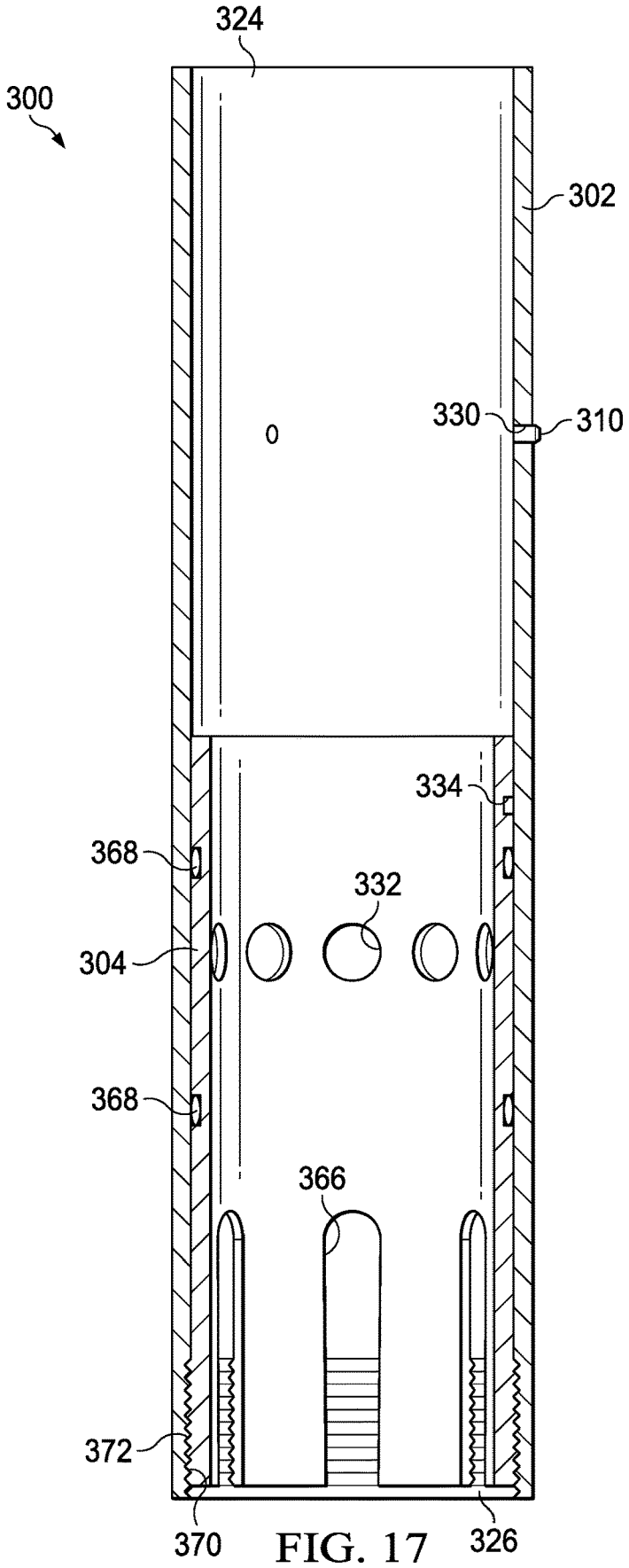
FIG. 17 illustrates a schematic, cross-section view of the diverter assembly of FIG. 11, after the first ball and second ball have been extruded through a first extrusion disk.

To re-establish downhole flow through the diverter assembly 300, the differential pressure within the tool string may be further increased to cause the second extrusion disk 342 to expand (as shown in FIG. 16), and again to cause the first extrusion disk 340 to expand (as shown in FIG. 17). When both the first extrusion disk 340 and second extrusion disk 342 have expanded, the inner bore of the tubing string may be relatively unoccluded, thereby facilitating the downhole flow of fluid within the tool string.

Figure 18:
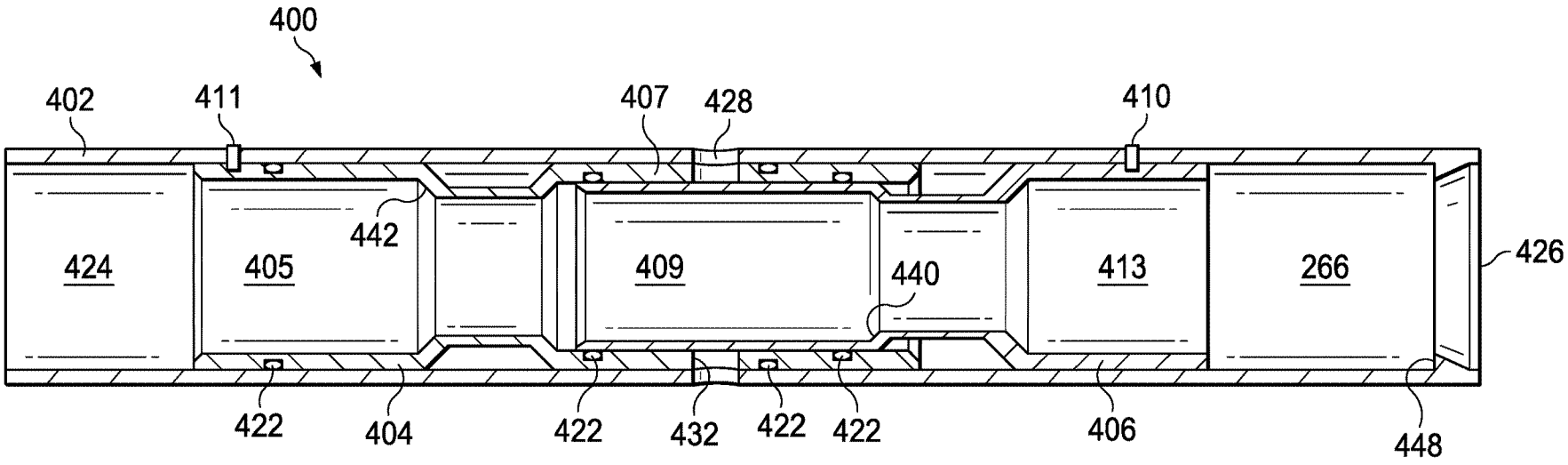
FIG. 18 illustrates a schematic, cross-section view of an embodiment of a diverter assembly in a run-in configuration.
Figure 19:
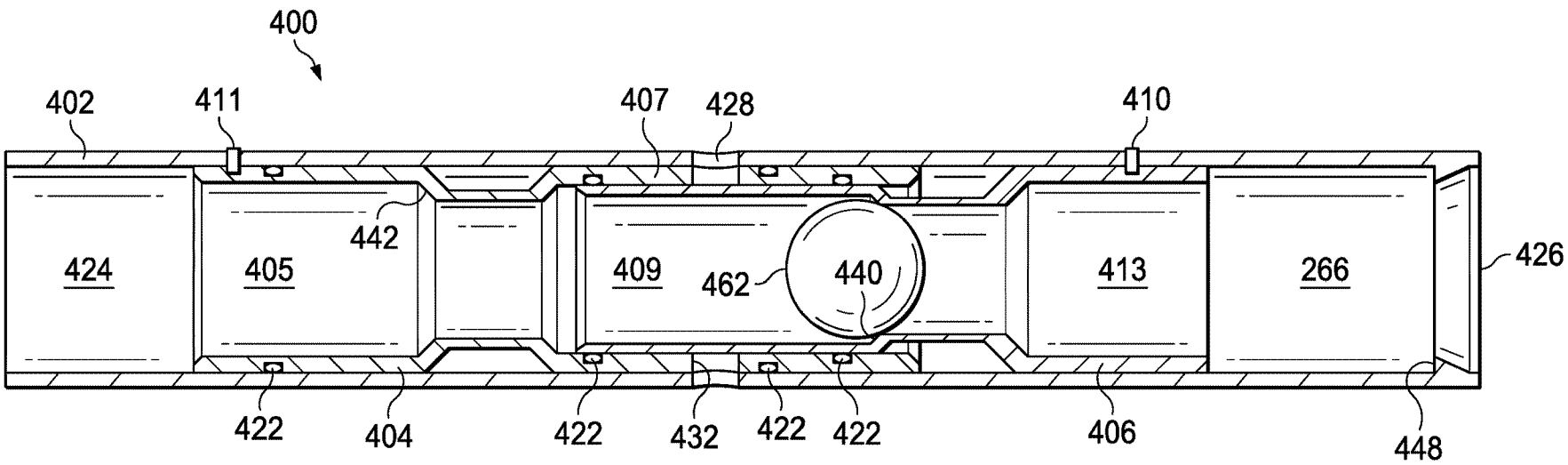
FIG. 19 illustrates a schematic, cross-section view of the diverter assembly of FIG. 18, shown here having received a first ball at a first extrudable seat of a lower sleeve.

A third embodiment of a diverter assembly 400 is described with regard to FIGS. 18-23. In the embodiment of FIG. 19, a diverter assembly 400 is shown that includes a tubing segment 402 having an inlet 424 and an outlet 426. The diverter assembly 400 may be inserted between upper and lower sections of a tool string, or piping disposed therein.

The diverter assembly 400 includes an upper sleeve 404 and lower sleeve 406 positioned within a primary bore 266 that is bounded by a shoulder 448 near the outlet of the tubing segment. The upper sleeve 404 has an outer diameter that allows the upper sleeve 404 to snugly fit within the primary bore 466. A sealed interface may be facilitated between the tubing segment 402 and upper sleeve 404 by one or more seals 422 positioned within grooves in the outer surface of the outer sleeve 204. The outer sleeve 204 includes an upper section 405 and a lower section 407. The upper section 405 includes a second seat 442, which may also be referred to as an upper seat. The second seat 442 may function as a seating surface for ball, dart, or similar occluding member. The lower section 407 includes sleeve apertures 432 (second apertures) that are aligned with tubing apertures 428 (first apertures) of the tubing segment 402 when the diverter assembly is in a first, unactuated configuration.

The lower sleeve 406 also includes an upper section 409 and a lower section 413. The upper section 409 of the lower sleeve 406 includes a first seat 440, which may also be referred to as a lower seat, and which is configured to receive a ball, dart, or similar occluding member. The upper section 409 of the lower sleeve 406 has an outer diameter that is equivalent to but slightly less than the inner diameter of the lower section 407 of the upper sleeve 404. A sealed interface may be facilitated between the outer surface of the upper section 409 of the lower sleeve 406 and the inner surface of the lower section 407 of the upper sleeve by one or more seals 422 positioned within grooves in the outer surface of the lower sleeve 406.

To maintain the upper sleeve 404 and lower sleeve 406 in an unactuated state, when the diverter assembly 400 is in the first configuration, first shear pins 410 may extend between the lower sleeve 406 and tubing segment 402. Similarly, second shear pins 411 may extend between the upper sleeve 404 and tubing segment 402 to anchor the upper sleeve relative to the tubing segment 402. When the diverter assembly 400 is in the first, unactuated configuration, the upper section 409 of the lower sleeve 406 blocks flow through the sleeve apertures 432 and aligned tubing apertures 428 to cause fluid in the tubing string to flow downhole within the tubing string rather than into the annulus via the aforementioned apertures.

Figure 20:
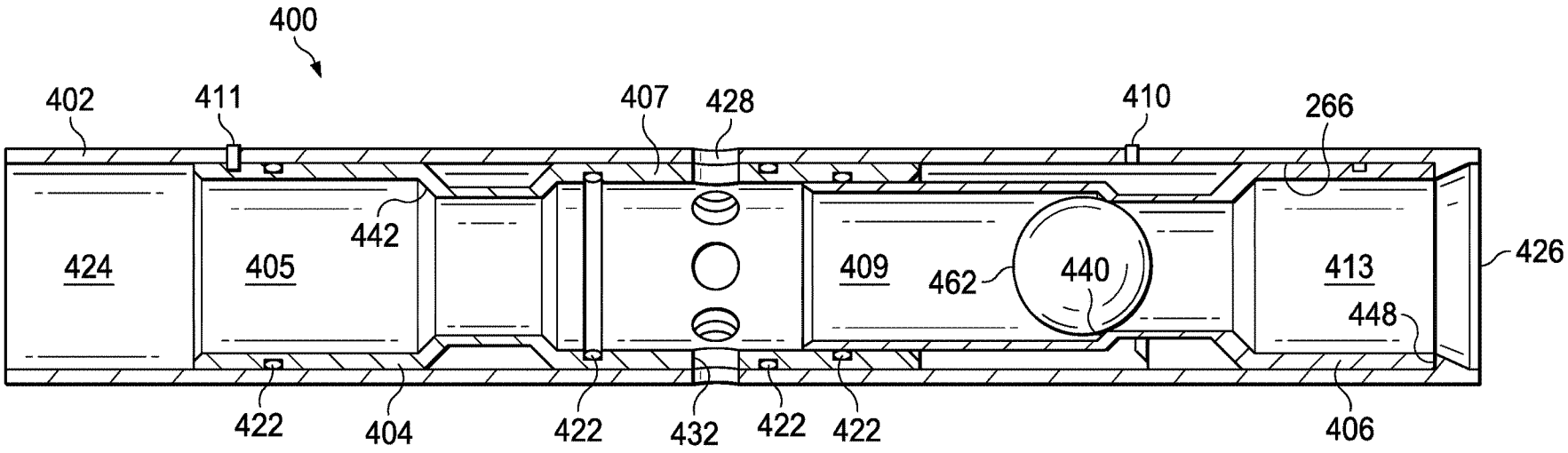
FIG. 20 illustrates a schematic, cross-section view of the diverter assembly of FIG. 18, after the lower sleeve has moved from a first position to a second position and the diverter assembly has correspondingly moved from a first configuration to a second configuration to open apertures of the diverter assembly.

A method of operating the diverter assembly 400 is shown in sequential steps in FIGS. 18-23. The diverter assembly 400 is deployed into a wellbore as a subassembly of a tool string with the diverter assembly 400 in a first, unactuated configuration, as shown in FIG. 18. To actuate the diverter assembly 400, a first ball 462 is dropped into the tool string and landed on the first seat 440, as shown in FIG. 19. The first ball 462 seals the bore of the tubing segment 402, thereby preventing fluid from flowing through the diverter assembly 400 and allowing pressure to increase in the tool string above the diverter assembly 400. When the differential pressure in the tool string above the first ball 462 reaches a predetermined threshold, the hydraulic force exerted on the lower sleeve 406 exceeds the shear strength of the first shear pins 410, thereby freeing the lower sleeve 406 to slide downhole within the tubing segment 402 to a second configuration in which the upper section 409 of the lower sleeve 406 is moved downhole of the sleeve apertures 432. In the second configuration, the lower section 413 of the lower sleeve 406 rests against the shoulder 448 of the tubing segment, as shown in FIG. 20.

When the diverter assembly 400 is in the second configuration, the sleeve apertures 432 are aligned with tubing segment apertures 428 and unblocked by the lower sleeve 406 to allow fluid to flow through the diverter assembly 400 to the annulus between the tool string and wellbore wall. The first ball 462 may remain landed on the first seat 440, thereby forcing fluid flowing from the tool string to the inlet 424 into the annulus via the diverter assembly 400 to enable a top-down squeeze operation.

Figure 21:
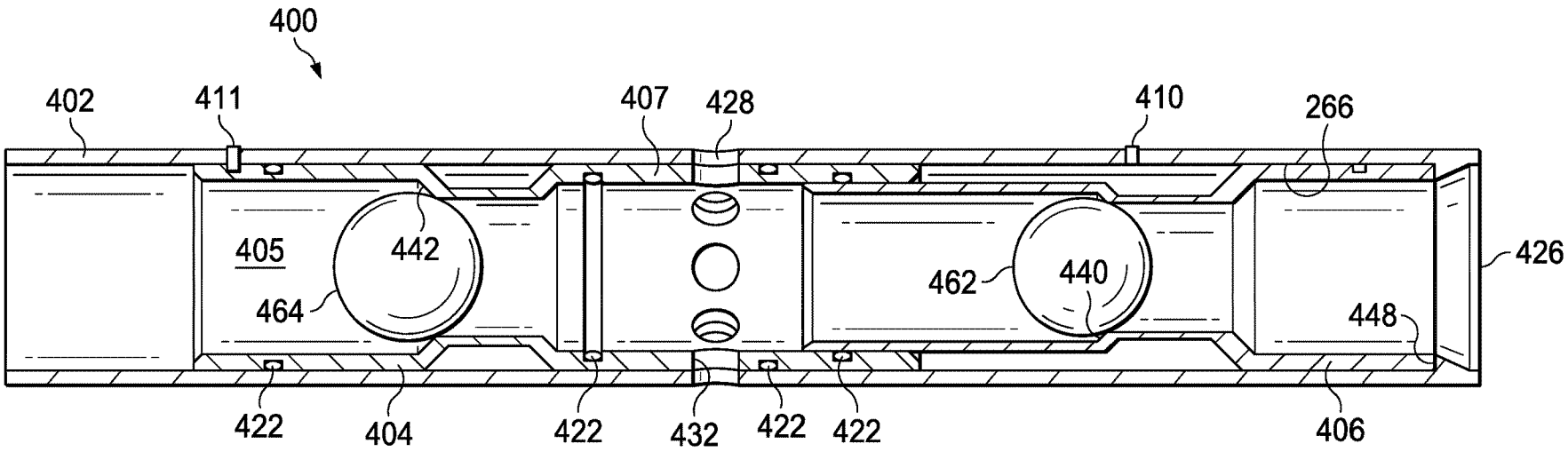
FIG. 21 illustrates a schematic, cross-section view of the diverter assembly of FIG. 18, shown here having received a second ball at a second extrudable seat of an upper sleeve.

Following completion of the operation, pressure may be increased to resume flow through the tool string and a second ball 464 may be deployed into the tool string to land on the second seat 442, as shown in FIG. 21. After the second ball 464 has landed on the second seat 442, differential pressure within the tool string may be increased to a second predetermined threshold at the inlet 424. When the pressure differential across the second ball 464 reaches the second predetermined threshold, the hydraulic force exerted on the upper sleeve 404 via the second ball 464 exceeds the shear strength of the second shear pins 411, thereby freeing the upper sleeve 404 to slide further downhole within the tubing segment 402 to a third configuration in which the upper sleeve 404 is landed on the lower sleeve 406.

Figure 22:
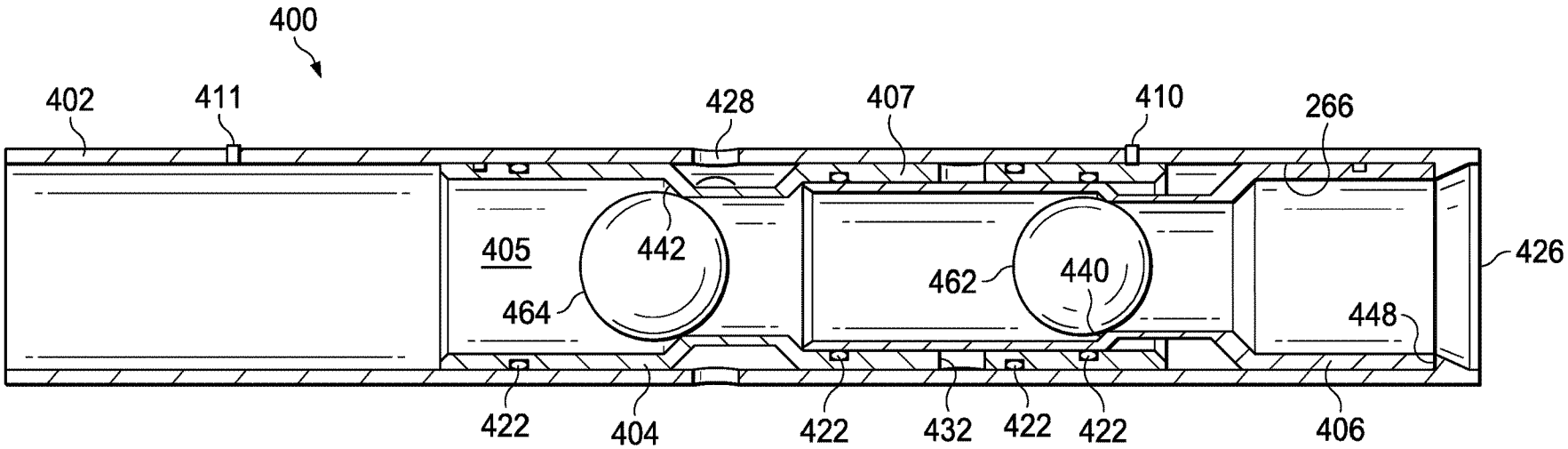
FIG. 22 illustrates a schematic, cross-section view of the diverter assembly of FIG. 18, after the upper sleeve of the diverter assembly has moved from a first position to a second position and the diverter assembly has correspondingly moved from a second configuration to a third configuration to close the apertures of the diverter assembly.

When the diverter assembly shifts from the second configuration to the third configuration, as shown in FIG. 22, the sleeve apertures 432 are misaligned with tubing segment apertures 428, thereby restricting fluid flow through the diverter assembly 400 to the annulus.

Figure 23:
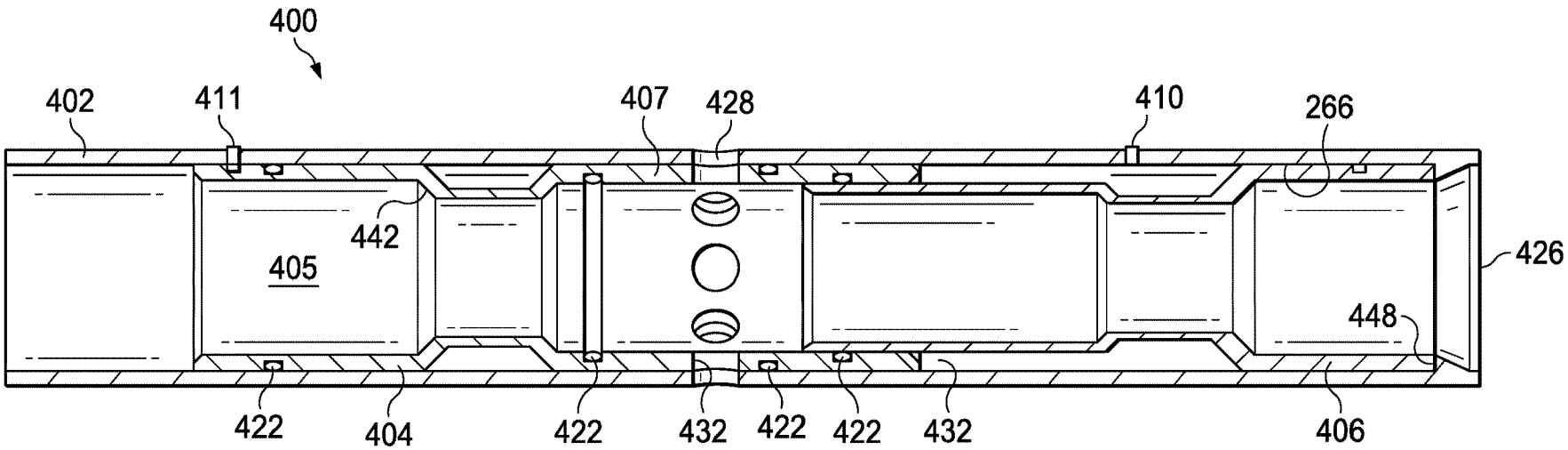
FIG. 23 illustrates a schematic, cross-section view of the diverter assembly of FIG. 18, after the first ball has been extruded through the first extrudable seat and the second ball has been extruded through the second extrudable seat a second extrusion disk.

To re-establish downhole flow through the diverter assembly 400, the pressure within the tool string may be further increased to cause first ball 462 and second ball 464 to clear the first seat 440 and second seat 442, respectively (as shown in FIG. 23). When both the first seat 440 and second seat 442 are cleared, the inner bore of the tubing string may be relatively unoccluded, thereby facilitating the downhole flow of fluid within the tool string or to actuate a tool, such as a liner hanger.

The above-disclosed embodiments have been presented for purposes of illustration and to enable one of ordinary skill in the art to practice the disclosure, but the disclosure is not intended to be exhaustive or limited to the forms disclosed. Many insubstantial modifications and variations will be apparent to those of ordinary skill in the art without departing from the scope and spirit of the disclosure. For example, it is noted that the features of the upper sleeve 404 and lower sleeve 406 of FIGS. 18-23 may generally be allocated to either sleeve member. For example, in some embodiments the upper sleeve 404 may block flow through the tubing apertures 428 and the sleeve apertures may be included in the lower sleeve 406 instead of the upper sleeve 404. Similarly, in some embodiments, the lower section 407 of the upper sleeve 404 may be nested within the upper section 409 of the lower sleeve 406 instead of the opposing configuration shown in the Figures.

Similarly, with respect to each of the embodiments, it is noted that the first ball and second ball are merely exemplary, and may be substituted for darts or similar devices that may land on a sealing seat to form a seal within a bore.

The scope of the claims is intended to broadly cover the disclosed embodiments and any such modification. Further, the following clauses represent additional embodiments of the disclosure and should be considered within the scope of the disclosure:

Clause 1: A downhole tool subassembly comprising: a tubing segment having a first set of apertures extending from an inner bore of the tubing segment through an external surface of the tubing segment; a first sleeve having a second set of apertures extending from a sleeve bore of the sleeve through an external surface of the sleeve, the first sleeve being operable to restrict flow across the first set of apertures when the first sleeve is in a first position; and a first frangible fastener coupling the tubing segment to the first sleeve when the first sleeve is in the first position, wherein the first sleeve further comprises a first sealing seat for receiving a first occluding member, the first sealing seat being operable to form a seal across the sleeve bore when the first sealing seat is engaged by the occluding member, and wherein the first frangible fastener is operable to fail upon a pressure differential across the seal reaching a predetermined threshold. The first sleeve may include an inner sleeve and intermediate sleeve, as shown in FIG. 3.

Clause 2: The downhole tool subassembly of clause 1, further comprising a second frangible fastener extending into the inner bore of the tubing segment, wherein the first sleeve further comprises a slot, wherein the first sleeve is operable to slide downhole to a second position in which an uphole boundary of the slot engages the second frangible fastener upon failure of the first frangible fastener, and wherein the second set of apertures align with the first set of apertures when the first sleeve is in the second position.

Clause 3: The downhole tool subassembly of clause 2, wherein the sealing seat is operable to release the first occluding member upon the pressure differential across the seal reaching a second predetermined threshold.

Clause 4: The downhole tool subassembly of clause 3, wherein the first sleeve further comprises a second sealing seat for receiving a second occluding member, the second occluding member having an outer diameter that is greater than the outer diameter of the first occluding member, wherein the second sealing seat is operable to form a second seal across the sleeve bore when the second sealing seat is engaged by the second occluding member.

Clause 5: The downhole tool subassembly of clause 4, wherein the tubing segment comprises an inner shoulder having an inner diameter that is less than an outer diameter of a base of the first sleeve.

Clause 6: The downhole tool subassembly of clause 5, wherein the first sleeve is operable to slide downhole to a third position in which the inner shoulder engages the base of the first sleeve upon failure of the second frangible fastener, and wherein the first sleeve is operable to restrict flow across the first set of apertures when the first sleeve is in the third position.

Clause 7: The downhole tool subassembly of clause 6, wherein the base of the first sleeve comprises an external latching surface that engages an internal latching surface of the tubing segment when the first sleeve is in the third position.

Clause 8: The downhole tool subassembly of any of clauses 4-7, wherein the second sealing seat is operable to release the second occluding member upon the pressure differential across the second seal reaching a third predetermined threshold.

Clause 9: The downhole tool subassembly of any of clauses 1-8, wherein the first sleeve comprises an uphole member and a downhole member.

Clause 10: The downhole tool subassembly of clause 9, wherein an upper portion of the downhole member is slidingly positioned within a downhole portion of the uphole member.

Clause 11: The downhole tool subassembly of clause 9 or clause 10, wherein the first frangible fastener engages and restricts movement of the downhole member when the first sleeve is in the first position, and wherein the downhole member comprises the first sealing seat.

Clause 12: A system for cementing a portion of a wellbore, the system comprising: a pressurized fluid source; a controller, and a downhole tool subassembly, the downhole tool subassembly comprising a tubing segment having a first set of apertures extending from an inner bore of the tubing segment through an external surface of the tubing segment, a first sleeve having a second set of apertures extending from a sleeve bore of the sleeve through an external surface of the sleeve, the first sleeve being operable to restrict flow across the first set of apertures when the first sleeve is in a first position, and a frangible fastener coupling the tubing segment to the first sleeve when the first sleeve is in the first position, wherein the first sleeve further comprises a first sealing seat for receiving a first occluding member, the first sealing seat being operable to form a seal across the sleeve bore when the first sealing seat is engaged by the first occluding member, and wherein frangible fastener is operable to fail upon a pressure differential across the seal reaching a predetermined threshold.

Clause 13: The system of clause 12, wherein the downhole tool subassembly further comprises a second frangible fastener extending into the inner bore of the tubing segment, wherein the first sleeve further comprises a slot, wherein the first sleeve is operable to slide downhole to a second position in which an uphole boundary of the slot engages the second frangible fastener upon failure of the first frangible fastener, and wherein the second set of apertures align with the first set of apertures when the first sleeve is in the second position.

Clause 14: The system of clause 13, wherein the first sealing seat is operable to release the first occluding member upon the pressure differential across the seal reaching a second predetermined threshold, and wherein the first sleeve further comprises a second sealing seat for receiving a second occluding member, the second occluding member having an outer diameter that is greater than the outer diameter of the first occluding member, wherein the second sealing seat is operable to form a second seal across the sleeve bore when the second sealing seat is engaged by the second occluding member.

Clause 15: The system of clause 14, wherein the tubing segment comprises an inner shoulder having an inner diameter that is less than an outer diameter of a base of the first sleeve, wherein the first sleeve is operable to slide downhole to a third position in which the inner shoulder engages the base of the first sleeve upon failure of the second frangible fastener, and wherein the first sleeve is operable to restrict flow across the first set of apertures when the first sleeve is in the third position.

Clause 16: A method of providing a fluid to an annulus of a wellbore, the method comprising: deploying a first ball to a downhole tool subassembly comprising: a tubing segment having a first set of apertures extending from an inner bore of the tubing segment through an external surface of the tubing segment; a first sleeve having a second set of apertures extending from a sleeve bore of the sleeve through an external surface of the sleeve, the first sleeve being in a first position in which the first sleeve restricts fluid flow across the first set of apertures when the first sleeve is in a first position; a frangible fastener coupling the tubing segment to the first sleeve when the first sleeve is in the first position;

landing the first occluding member at a first sealing seat of the first sleeve to form a seal across the sleeve bore; and increasing hydrostatic pressure to a predetermined threshold at an inlet of the tubing segment to cause the frangible fastener to fail.

Clause 17: The method of clause 16, wherein the downhole tool subassembly further comprises a second frangible fastener extending into the inner bore of the tubing segment, and wherein the first sleeve further comprises a slot, the method further including causing the first sleeve to slide downhole to a second position in which an uphole boundary of the slot engages the second frangible fastener upon and the second set of apertures align with the first set of apertures.

Clause 18: The method of clause 17, further comprising increasing hydrostatic pressure to a second predetermined threshold to extrude the first occluding member through the first sealing seat.

Clause 19: The method of clause 18, wherein the first sleeve further comprises a second sealing seat, the method comprising receiving a second occluding member at the second sealing seat and forming a second seal across the sleeve bore when the second sealing seat is engaged by the second occluding member.

Clause 20: The method of clause 18, further comprising sliding the first sleeve downhole to a third position in which an inner shoulder of the tubing segment engages a base of the first sleeve, and restricting flow across the first set of apertures when the first sleeve is in the third position.

Unless otherwise specified, any use of any form of the terms "connect," "engage," "couple," "attach," or any other term describing an interaction between elements in the foregoing disclosure is not meant to limit the interaction to direct interaction between the elements and may also include indirect interaction between the elements described. As used herein, the singular forms "a", "an" and "the" are intended to include the plural forms as well, unless the context clearly indicates otherwise. Unless otherwise indicated, as used throughout this document, "or" does not require mutual exclusivity. It will be further understood that the terms "comprise" and/or "comprising," when used in this specification and/or the claims, specify the presence of stated features, steps, operations, elements, and/or components, but do not preclude the presence or addition of one or more other features, steps, operations, elements, components, and/or groups thereof. In addition, the steps and components described in the above embodiments and figures are merely illustrative and do not imply that any particular step or component is a requirement of a claimed embodiment.

It should be apparent from the foregoing that embodiments of an invention having significant advantages have been provided. While the embodiments are shown in only a few forms, the embodiments are not limited but are susceptible to various changes and modifications without departing from the spirit thereof

We claim:

1. A downhole tool subassembly comprising:

a tubing segment having a first set of apertures extending from an inner bore of the tubing segment through an external surface of the tubing segment;

a first sleeve having a second set of apertures extending from a sleeve bore of the sleeve through an external surface of the sleeve, the first sleeve being operable to restrict flow across the first set of apertures when the first sleeve is in a first position;

a first frangible fastener coupling the tubing segment to the first sleeve when the first sleeve is in the first position; and a second frangible fastener extending into the inner bore of the tubing segment;

wherein the first sleeve further comprises a first sealing seat for receiving a first occluding member, the first sealing seat being operable to form a seal across the sleeve bore when the first sealing seat is engaged by the occluding member;

wherein the first sleeve further comprises a hole configured to receive the first frangible fastener and a slot configured to receive the second frangible fastener;

wherein the first frangible fastener is operable to fail upon a pressure differential across the seal reaching a predetermined threshold;

wherein the first sleeve is operable to slide downhole to a second position in which the second frangible fastener engages a top of the slot after failure of the first frangible fastener, and wherein the second set of apertures align with the first set of apertures when the first sleeve is in the second position.

2. The downhole tool subassembly of claim 1, wherein the sealing seat is operable to release the first occluding member upon the pressure differential across the seal reaching a second predetermined threshold.

3. The downhole tool subassembly of claim 2, wherein the first sleeve further comprises a second sealing seat for receiving a second occluding member, the second occluding member having an outer diameter that is greater than the outer diameter of the first occluding member, wherein the second sealing seat is operable to form a second seal across the sleeve bore when the second sealing seat is engaged by the second occluding member.

4. The downhole tool subassembly of claim 3, wherein the tubing segment comprises an inner shoulder having an inner diameter that is less than an outer diameter of a base of the first sleeve.

5. The downhole tool subassembly of claim 4, wherein the first sleeve is operable to slide downhole to a third position in which the inner shoulder engages the base of the first sleeve upon failure of the second frangible fastener, and wherein the first sleeve is operable to restrict flow across the first set of apertures when the first sleeve is in the third position.

6. The downhole tool subassembly of claim 5, wherein the base of the first sleeve comprises an external latching surface that engages an internal latching surface of the tubing segment when the first sleeve is in the third position.

7. The downhole tool subassembly of claim 4, wherein the second sealing seat is operable to release the second occluding member upon the pressure differential across the second seal reaching a third predetermined threshold.

8. The downhole tool subassembly of claim 1, wherein the first sleeve comprises an uphole member and a downhole member.

9. The downhole tool subassembly of claim 8, wherein an upper portion of the downhole member is slidingly positioned within a downhole portion of the uphole member.

10. The downhole tool subassembly of claim 8, wherein the first frangible fastener engages and restricts movement of the downhole member when the first sleeve is in the first position, and wherein the downhole member comprises the first sealing seat.

11. A system for cementing a portion of a wellbore, the system comprising:

a pressurized fluid source;

a controller, and downhole tool subassembly, the downhole tool subassembly comprising a tubing segment having a first set of apertures extending from an inner bore of the tubing segment through an external surface of the tubing segment, a first sleeve having a second set of apertures extending from a sleeve bore of the sleeve through an external surface of the sleeve, the first sleeve being operable to restrict flow across the first set of apertures when the first sleeve is in a first position, and a first frangible fastener coupling the tubing segment to the first sleeve when the first sleeve is in the first position;

wherein the first sleeve further comprises a first sealing seat for receiving a first occluding member, the first sealing seat being operable to form a seal across the sleeve bore when the first sealing seat is engaged by the first occluding member, wherein frangible fastener is operable to fail upon a pressure differential across the seal reaching a predetermined threshold wherein the downhole tool subassembly further comprises a second frangible fastener extending into the inner bore of the tubing segment, wherein the first sleeve further comprises a hole configured to receive the first frangible fastener and a slot configured to receive the second frangible fastener, wherein the first sleeve is operable to slide downhole to a second position in which an uphole boundary of the slot engages the second frangible fastener after failure of the first frangible fastener, and wherein the second set of apertures align with the first set of apertures when the first sleeve is in the second position.

12. The system of claim 11, wherein the first sealing seat is operable to release the first occluding member upon the pressure differential across the seal reaching a second predetermined threshold, and wherein the first sleeve further comprises a second sealing seat for receiving a second occluding member, the second occluding member having an outer diameter that is greater than the outer diameter of the first occluding member, wherein the second sealing seat is operable to form a second seal across the sleeve bore when the second sealing seat is engaged by the second occluding member.

13. The system of claim 12, wherein the tubing segment comprises an inner shoulder having an inner diameter that is less than an outer diameter of a base of the first sleeve, wherein the first sleeve is operable to slide downhole to a third position in which the inner shoulder engages the base of the first sleeve upon failure of the second frangible fastener, and wherein the first sleeve is operable to restrict flow across the first set of apertures when the first sleeve is in the third position.

14. A method of providing a fluid to an annulus of a wellbore, the method comprising:

deploying a first occluding member to a downhole tool subassembly comprising:

a tubing segment having a first set of apertures extending from an inner bore of the tubing segment through an external surface of the tubing segment;

a first sleeve having a second set of apertures extending from a sleeve bore of the sleeve through an external surface of the sleeve, the first sleeve being in a first position in which the first sleeve restricts fluid flow across the first set of apertures when the first sleeve is in a first position;

a frangible fastener coupling the tubing segment to the first sleeve when the first sleeve is in the first position;

positioning the first occluding member at a first sealing seat of the first sleeve to form a seal across the sleeve bore; and increasing hydrostatic pressure to a predetermined threshold at an inlet of the tubing segment to cause the frangible fastener to fail;

wherein the downhole tool subassembly further comprises a second frangible fastener extending into the inner bore of the tubing segment, and wherein the first sleeve further comprises a hole configured to receive the first frangible fastener and a slot configured to receive the second frangible fastener, the method further including causing the first sleeve to slide downhole to a second position in which an uphole boundary of the slot engages the second frangible fastener upon and the second set of apertures align with the first set of apertures.

15. The method of claim 14, further comprising increasing hydrostatic pressure to a second predetermined threshold to extrude the first occluding member through the first sealing seat.

16. The method of claim 15, wherein the first sleeve further comprises a second sealing seat, the method comprising receiving a second occluding member at the second sealing seat and forming a second seal across the sleeve bore when the second sealing seat is engaged by the second occluding member.

17. The method of claim 15, further comprising sliding the first sleeve downhole to a third position in which an inner shoulder of the tubing segment engages a base of the first sleeve, and restricting flow across the first set of apertures when the first sleeve is in the third position.

* * * * *